US008746997B2

(12) United States Patent
Takeuchi et al.

(10) Patent No.: US 8,746,997 B2
(45) Date of Patent: Jun. 10, 2014

(54) RECORDING APPARATUS AND SHEET PROCESSING METHOD

(71) Applicant: Canon Kabushiki Kaisha, Tokyo (JP)

(72) Inventors: Toshiki Takeuchi, Yokohama (JP); Yasuhiko Ikeda, Sagamihara (JP); Koichiro Kawaguchi, Yokohama (JP); Kengo Nieda, Kawasaki (JP); Masahito Yoshida, Shiki (JP); Masato Izumi, Kawasaki (JP); Kenji Shigeno, Yokohama (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/783,865

(22) Filed: Mar. 4, 2013

(65) Prior Publication Data

US 2013/0270062 A1 Oct. 17, 2013

Related U.S. Application Data

(62) Division of application No. 12/825,162, filed on Jun. 28, 2010, now Pat. No. 8,408,827.

(30) Foreign Application Priority Data

Jun. 30, 2009 (JP) ..... 2009-155674
Apr. 14, 2010 (JP) ..... 2010-093357

(51) Int. Cl.
*B41J 11/44* (2006.01)
*B41J 29/38* (2006.01)
*B41J 29/393* (2006.01)

(52) U.S. Cl.
USPC ..... 400/76; 347/14; 347/19

(58) Field of Classification Search
CPC ..... B41J 11/008; B41J 15/00; B41J 15/04
USPC ..... 400/76, 583, 583.3, 611; 347/14, 19, 347/133
See application file for complete search history.

(56) References Cited

U.S. PATENT DOCUMENTS 6,575,546 B2 * 6/2003 Matsumoto et al. ..... 347/14
2008/0193148 A1 * 8/2008 Bonino ..... 399/15

* cited by examiner

*Primary Examiner* — Ren Yan
*Assistant Examiner* — Blake A Tankersley
(74) *Attorney, Agent, or Firm* — Canon USA, Inc. IP Division

(57) ABSTRACT

A method includes pulling out and conveying a sheet having splice portions, acquiring information relating to a position of an indentation on the sheet formed in addition to a splice portion, and performing processing on the sheet but a position corresponding to the acquired position of the indentation and its vicinity.

4 Claims, 25 Drawing Sheets

RECORDING APPARATUS AND SHEET PROCESSING METHOD

CROSS-REFERENCE TO RELATED APPLICATION

This application is a Divisional of U.S. application Ser. No. 12/825,162, filed Jun. 28, 2010, Japanese Patent Applications No. 2009-155674 filed Jun. 30, 2009 and No. 2010-093357 filed Apr. 14, 2010, which are hereby incorporated by reference herein in their entireties.

BACKGROUND OF THE INVENTION

1. Field of the Invention

The present invention relates to a recording apparatus that can perform printing using a roll of continuously connected sheets.

2. Description of the Related Art

A roll of continuously connected sheets is used for a large amount of print job that is, for example, performed in a laboratory shop. From the viewpoint of yield in manufacturing a roll of continuously connected sheets, edge portions of respective sheets with fixing members such as a splicing tape (hereinafter, referred to as "tape") are to be connected if the sheets are shorter than a required length.

In this case, the sheet roll of continuously connected sheets includes at least one splice portion (joint portion) that is connected by taping and provided at an arbitrary position. If a recording apparatus performs printing using a sheet roll having at least one splice portion that continuously connect two sheets, an image may be recorded at the splice portion. In other words, the recording apparatus may produce a defective image.

To solve the above-described situation, a conventional apparatus discussed in Japanese Patent Application Laid-Open No. 2001-239715 uses an optical sensor to detect a tape that is used to fix a splice portion, and identifies a position where the splice portion is present based on a detection signal of the optical sensor, and then controls a conveyance mechanism and a printing device so as not to perform printing at the splice portion.

However, according to the conventional apparatus discussed in Japanese Patent Application Laid-Open No. 2001-239715, an object to be detected by the optical sensor is limited to the splice portion itself. However, in a manufacturing process of a sheet roll of a plurality of sheets continuously connected at splice portions or in a state where a manufactured sheet roll is stored, a sheet portion that contacts a step height of a tape is subjected to the winding pressure applied to the sheet to form the roll. Therefore, the sheet surface is partly deformed into a thin indentation at the portion where the sheet contacts the step height of the tape. If the sheet roll of continuously connected sheets partly deformed into thin indentations is directly used for printing, a recording apparatus may print an image at a deformed sheet portion corresponding to the indentation. As a result, the recording apparatus may produce a printed product including a defective image. Therefore, a user is to visually check each printed product to discriminate between normal product and defective product.

SUMMARY OF THE INVENTION

According to an aspect of the present invention, an apparatus includes a holding unit configured to hold a roll of a sheet having splice portions, a printing unit configured to record an image on the sheet while the sheet is conveyed, a detection unit configured to detect a splice portion of the sheet, an acquisition unit configured to acquire information relating to an outer circumferential length of the roll, and a control unit configured to control so as to prevent the printing unit from recording an effective image at or in the vicinity of an upstream position spaced from the splice portion by an amount equivalent to the outer circumferential length of the roll, based on a detection result of the splice portion and the acquired information.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 includes FIG. 6A and FIG. 6B.

FIG. 14 includes FIG. 14A and FIG. 14B.

DESCRIPTION OF THE EMBODIMENTS

Various exemplary embodiments, features, and aspects of the invention will be described in detail below with reference to the drawings.

The present invention is widely applicable to printers using a rolled sheet, such as multi-function peripherals, copying machines, facsimile apparatuses, manufacturing apparatuses of various devices, and other various printing apparatuses. Further, the present invention is not limited to print processing and is applicable to a sheet processing apparatus that performs various processing (recording, processing, coating, irradiation, reading, inspection, etc.) on a rolled sheet. An inkjet recording apparatus according to an exemplary embodiment of the present invention is described below.

Figure 1:
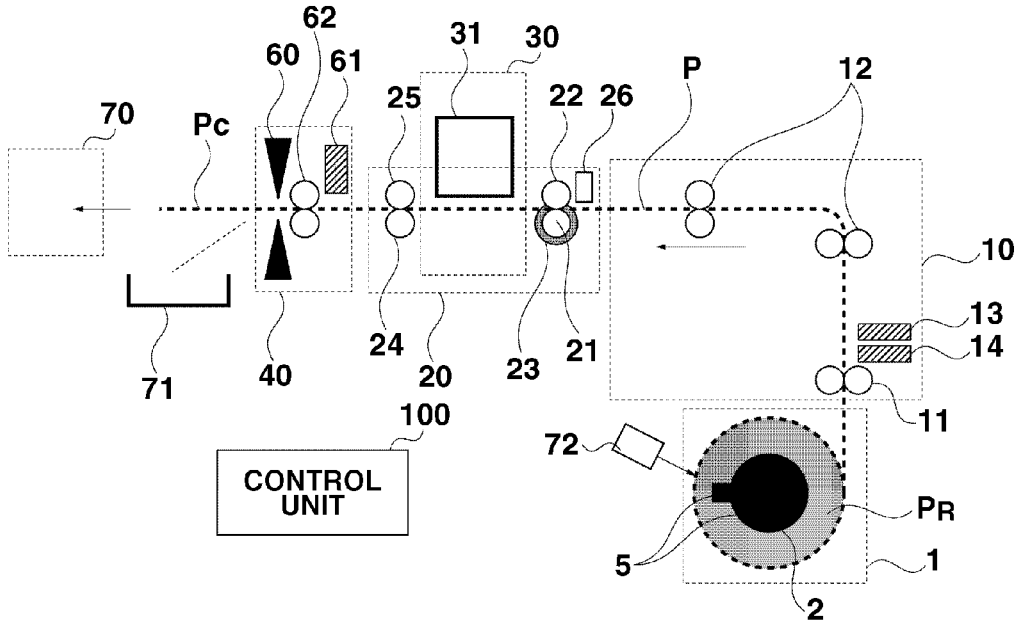
FIG. 1 illustrates an example of a configuration of principal portions of a recording apparatus according to a first exemplary embodiment of the preset invention.
Figure 2:
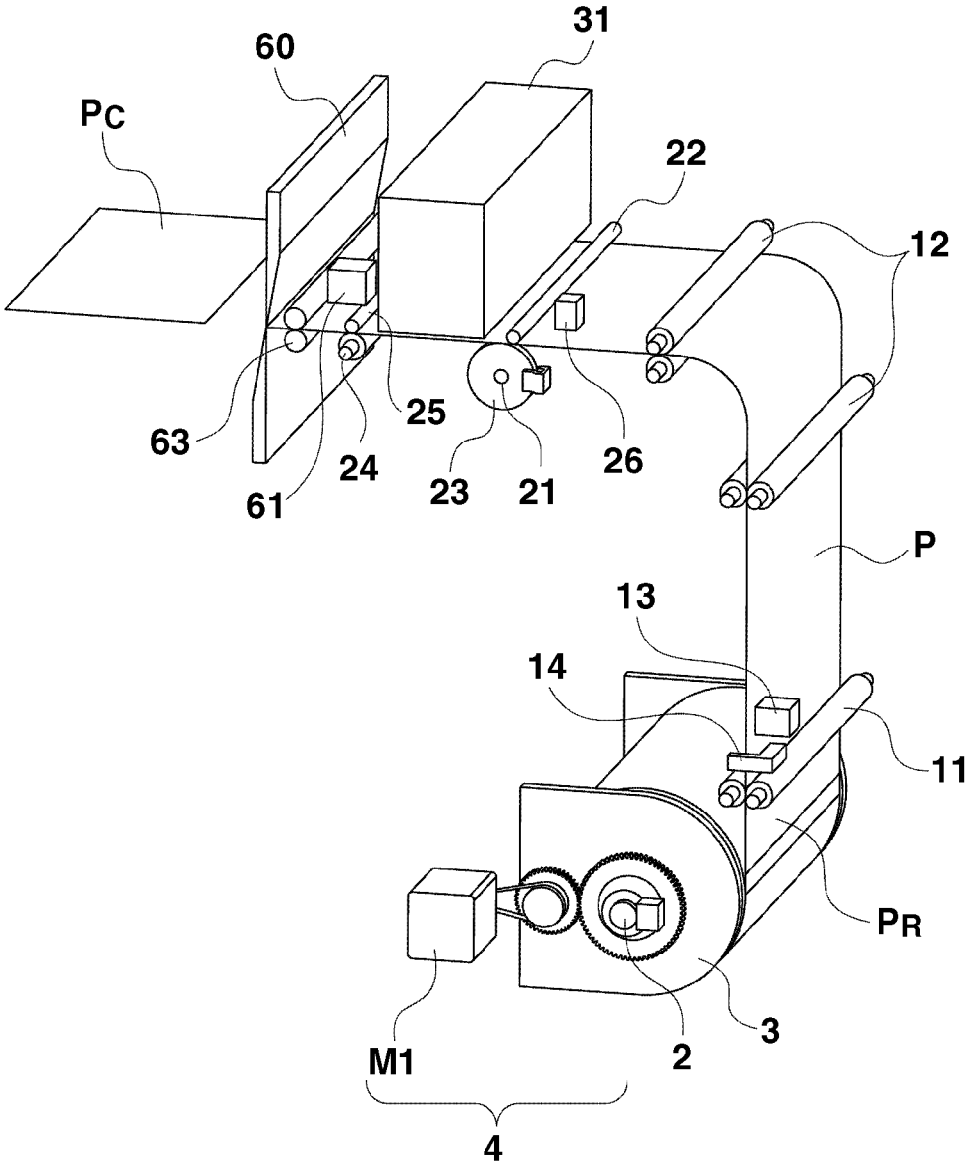
FIG. 2 is a perspective view of the principal portions of the recording apparatus illustrated in FIG. 1.

FIG. 1 illustrates an example of a configuration of principal portions of the inkjet recording apparatus according to a first exemplary embodiment of the preset invention. FIG. 2 illustrates a perspective view of the principal portions of the inkjet recording apparatus illustrated in FIG. 1.

A recording medium usable in the inkjet recording apparatus illustrated in FIG. 1 is a rolled sheet that includes continuously connected sheets wound in a roll form. In the following description of the present exemplary embodiment, the rolled sheet may be referred to as a "sheet P" and a sheet portion wound into a roll form may be referred to a "roll $P_R$." In the following description of the present exemplary embodiment, the "sheet" is an assembly of continuously elongated sheets made of paper, plastic, film, or metal plate.

In the following description of the present exemplary embodiment, the terms "upstream" and "downstream" are referred to as "upstream" and "downstream" directions of a sheet being conveyed when printing is performed on the sheet. In other words, a sheet holding mechanism that holds a sheet at an arbitrary position of a sheet conveyance path is located on the upstream side.

The inkjet recording apparatus includes a sheet holding device 1, a sheet feeding device 10, a sheet conveyance device 20, a printing device 30, and a cutting device 40. The sheet holding device 1 can hold a sheet P. The sheet feeding device 10 can feed the sheet P from the sheet holding device 1 to the sheet conveyance device 20. The printing device 30 can perform image recording processing on the sheet P. The sheet conveyance device 20 can convey the sheet P when the printing device 30 performs a print operation. The cutting device 40 can cut the sheet P. The sheet feeding device 10 and the sheet conveyance device 20 cooperatively constitute a sheet conveyance mechanism.

A post-processing device 70, which can perform post-processing on the sheet P having been subjected to the image recording processing, is connected to a downstream side of the cutting device 40. The post-processing to be performed by the post-processing device 70 includes ink drying processing and sorting processing. The inkjet recording apparatus further includes a collection box 71 that can collect waste products, such as a defective product and a cut edge of each cut sheet Pc, discharged from the cutting device 40. A control unit 100 controls various operations and processing that can be performed by the recording apparatus.

The sheet holding device 1 is described below in more detail. A sheet settable in the sheet holding device 1 is a sheet roll (roll $P_R$), which is an elongated rolled sheet having an entire length of, for example, several tens to hundreds meters and wound into a roll form. The roll $P_R$ includes a plurality of splice portions (joint portions by taping) appearing at random. The roll $P_R$ is rotatable around its core (which defines a rotational axis) in a state where the roll $P_R$ is supported by the sheet holding device 1. The sheet holding device 1 includes a holding shaft 2, a shaft holder 3, and a driving force transmission device 4. The holding shaft 2 is integrated with the core of the roll $P_R$. The shaft holder 3 is fixed to an apparatus chassis. The shaft holder 3 can support the holding shaft 2 while allowing the holding shaft 2 to rotate freely around its rotational axis. The driving force transmission device 4 includes a driving motor M1 that can drive the roll $P_R$ to rotate together with the holding shaft 2.

A rotary encoder 5, which is provided on the holding shaft 2, can detect a rotational state (e.g., rotational amount, rotational angle, etc.) of the roll $P_R$. When a print operation or a maintenance work is performed, the driving motor M1 rotates the roll $P_R$ to perform an operation for guiding a front end of the sheet P to an insertion slot of a sheet feeding roller pair 11 of the sheet feeding device 10 and an operation for winding up the sheet P into the roll $P_R$. After the front end of the sheet P is nipped by the sheet feeding roller pair 11, a clutch (not illustrated) disengages the holding shaft 2 from the driving motor M1 to enable the roll $P_R$ to rotate freely.

Further, a remaining amount sensor 72 capable of detecting a remaining amount of the roll $P_R$ is provided. The remaining amount sensor 72 measures an outer diameter of the roll $P_R$ and determines the remaining amount of the roll $P_R$ based on a measurement value of the outer diameter. The remaining amount sensor 72 can be selected from various distance sensors and position sensors that may be a non-contact type or a contact type. For example, a laser distance meter can be used to emit a measurement beam that travels from an outer circumferential side of the roll $P_R$ toward the core, thereby measuring a distance corresponding to the outer diameter of the roll $P_R$ and obtaining the remaining amount information based on the measured outer diameter value.

The sheet feeding device 10 is described below in more detail. The sheet feeding device 10 includes the sheet feeding roller pair 11 (i.e., a pair of sheet feeding rollers) and two auxiliary roller pairs 12. When the sheet P is conveyed from the sheet holding device 1, the front end of the sheet P is nipped by the sheet feeding roller pair 11. A sheet feeder driving motor M2 (not illustrated) rotates the sheet feeding roller pair 11 to convey the sheet P forward. The sheet P is further conveyed via two auxiliary roller pairs 12 to the sheet conveyance device 20.

The sheet feeding device 10 is equipped with a splice sensor 13 and a sheet sensor 14 that are provided in the vicinity of the sheet feeding roller pair 11. The splice sensor 13 serves as a detection unit capable of detecting a splice portion of the sheet P. The sheet sensor 14 can detect an edge portion of the sheet P. An example operation that can be performed by the detection unit is described below in detail.

The sheet conveyance device 20 is described below in more detail. The sheet conveyance device 20 includes a roller pair, which is a combination of a main conveyance roller 21 and a driven roller 22, disposed on an upstream side of the printing device 30. The sheet conveyance device 20 further includes another roller pair, which is a combination of a sub conveyance roller 24 and a driven roller 25, disposed on a downstream side of the printing device 30. The main conveyance roller 21 is driven by a conveyance driving motor M3 (not illustrated). A rotary encoder 23 is provided on a rotational shaft to detect a rotational state (e.g., rotational angle, rotational speed, etc.) of the main conveyance roller 21.

The force for driving the main conveyance roller 21 is transmitted to the sub conveyance roller 24. The sub conveyance roller 24 rotates in synchronization with the main conveyance roller 21. However, the main conveyance roller 21 and the sub conveyance roller 24 can be independently driven by different driving sources. A sheet sensor 26 is provided in front of (on the upstream side of) the driven roller 22. The sheet sensor 26 can detect a front end of the sheet P when the sheet P is fed from the sheet feeding device 10.

The printing device 30 is described below in more detail. The printing device 30 includes a line-type recording head 31. The recording head 31 has a recording width that is comparable to the maximum recording width of the sheet P. The control unit 100 controls recording timing based on signal detection timing of the rotary encoder 23. In the present exemplary embodiment, the recording head 31 is an inkjet recording head. However, the recording head 31 can be any other type of recording head, which may use heater elements, piezoelectric elements, electrostatic elements, or Micro Electro Mechanical Systems (MEMS) elements.

The present invention is applicable not only to inkjet printers but also to electro-photographic printers, thermal printers (sublimation type, heat transfer type, etc.), dot impact printers, liquid development printers, and other various printers.

The cutting device 40 is described below in more detail. The cutting device 40 includes a cutter 60 that can be used to cut a sheet, a cut mark sensor 61 positioned on the upstream side of the cutter 60, and a conveyance roller pair 62. The cut mark sensor 61 can detect a cut mark printed on the sheet. The cutting device 40 drives the cutter 60 to cut the sheet based on a signal detected by the cut mark sensor 61.

Figure 3:
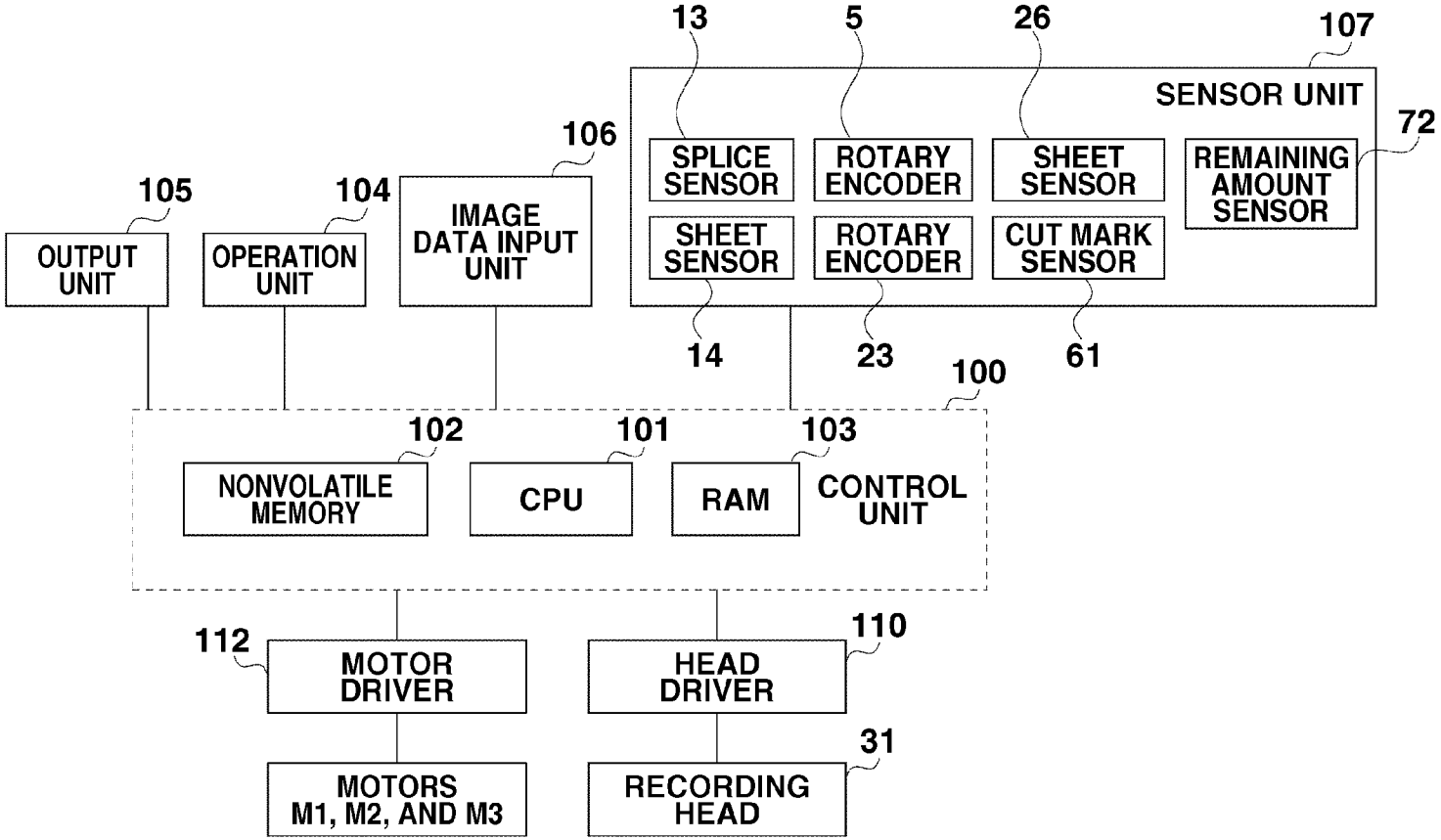
FIG. 3 is a block diagram illustrating an overall arrangement of the control system according to the first exemplary embodiment of the present invention.

Next, an example of a control system that controls the recording apparatus is described below in more detail. FIG. 3 is a block diagram illustrating an overall arrangement of the control system. The control unit 100, which is indicated by a dotted line, includes a central processing unit (CPU) 101, a nonvolatile memory 102, and a random access memory (RAM) 103. The CPU 101 can control various processing and operations to be performed by the recording apparatus. The nonvolatile memory 102 stores fixed data such as various programs. The RAM 103 can serve as a work area for the CPU 101 when the CPU 101 executes various programs loaded from the nonvolatile memory 102.

An operation unit 104 includes various switches (including a power switch) that can be operated by a user, for example, to perform setting of various parameters for a printing operation and input a print start instruction. An output unit 105 includes a display device that can perform status display and error display. An image data input unit 106 is an input interface that can input data of an effective image to be printed from a host device (e.g., a personal computer) or an image input device (e.g., a scanner or a digital camera).

A sensor unit 107 includes various sensors, each of which can acquire information relating to an operational state of the recording apparatus. More specifically, the sensor unit 107 includes the rotary encoder 5 (i.e., a sensor capable of detecting a rotational state of the roll $P_R$), the splice sensor 13, the sheet sensor 14, the rotary encoder 23, the sheet sensor 26, the cut mark sensor 61, and the remaining amount sensor 72. A head driver 110 drives the recording head 31 to discharge ink according to a recording signal supplied from the control unit 100. A motor driver 112 can be used to drive various motors provided in the recording apparatus, such as the above-described driving motors M1, M2, and M3.

Examples of operations that can be performed by the recording apparatus according to the present exemplary embodiment are described below in more detail. The control unit 100 controls all operations that can be performed by the recording apparatus. Prior to detailed descriptions of the operations, an example of the splice portion of the sheet roll $P_R$ is described below in more detail.

In a manufacturing process of a roll of continuously connected sheets, two consecutive sheets are connected with a tape 42 (i.e., a joint member) at either a front side or a reverse side or at both sides. A joint portion formed by the tape 42 is generally referred to as a "splice portion." Therefore, one sheet roll includes a plurality of splice portions that are provided at random to continuously connect neighboring sheets arrayed in the longitudinal direction.

Figure 4:
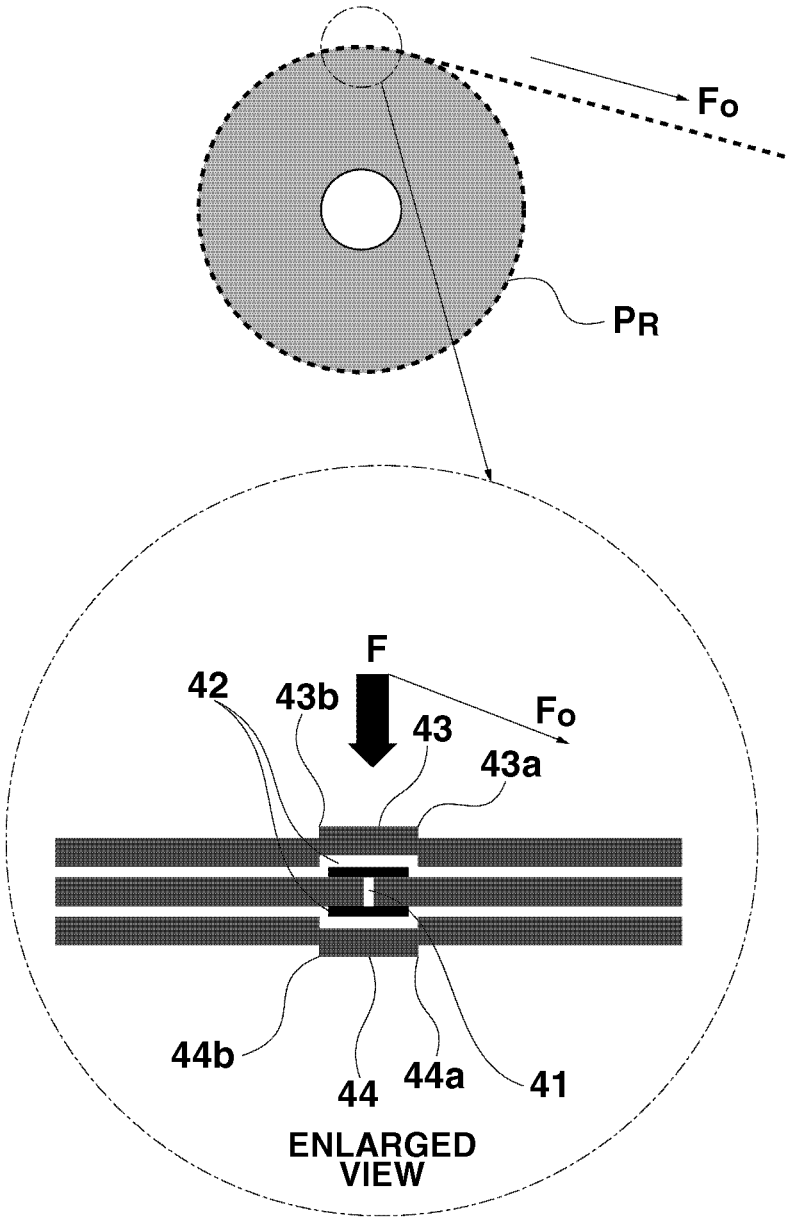
FIG. 4 is an enlarged view illustrating a splice portion of a roll $P_R$.

FIG. 4 is an enlarged view illustrating a representative splice portion 41 of the roll $P_R$. Two neighboring sheets are connected at the splice portion 41 with the tape 42 at both (front and reverse) surfaces thereof. In the manufacturing of a sheet roll, tension $F_0$ is constantly applied to the sheet P when the sheet P (i.e., an assembly of continuously connected sheets) is wound into a roll form. In this case, a component of the tension $F_0$ acts on the sheet P as winding pressure F. Therefore, the sheet P is compressed by the winding pressure F.

The tape 42 has a predetermined thickness. Therefore, the tape 42 forms a step height (i.e., a stepped or raised portion) on the sheet surface. When the winding pressure F acts on the sheet P, a physical indentation (hereinafter, simply referred to as "indentation" in the following description of the present exemplary embodiment) is formed on an adjacent sheet whose surface contacts the tape 42. Namely, the tape 42 forms an emboss-like indentation on a surface of an adjacent sheet. More specifically, a thin indentation 43 substantially identical to the tape 42 in size is formed on a neighboring sheet that contacts a front surface side of the tape 42. Similarly, a thin indentation 44 substantially identical to the tape 42 in size is formed on another neighboring sheet that contacts a reverse surface side of the tape 42.

A step height 43*a* is formed at a downstream edge portion of the downstream side indentation 43. A step height 43*b* is formed at an upstream edge portion of the downstream side indentation 43. A step height 44*a* is formed at a downstream edge portion of the upstream side indentation 44. A step height 44*b* is formed at an upstream edge portion of the upstream side indentation 44. In a state where the sheet P is pulled out of the roll $P_R$, a thickness change at each step height of the indentation 43 and the indentation 44 is small. However, if an image is printed on the sheet P, a significant change in color tone that can be recognized by human eyes occurs at a position corresponding to an embossed step height of each indentation. As a result, a print product including a defective image may be produced.

Figure 5:
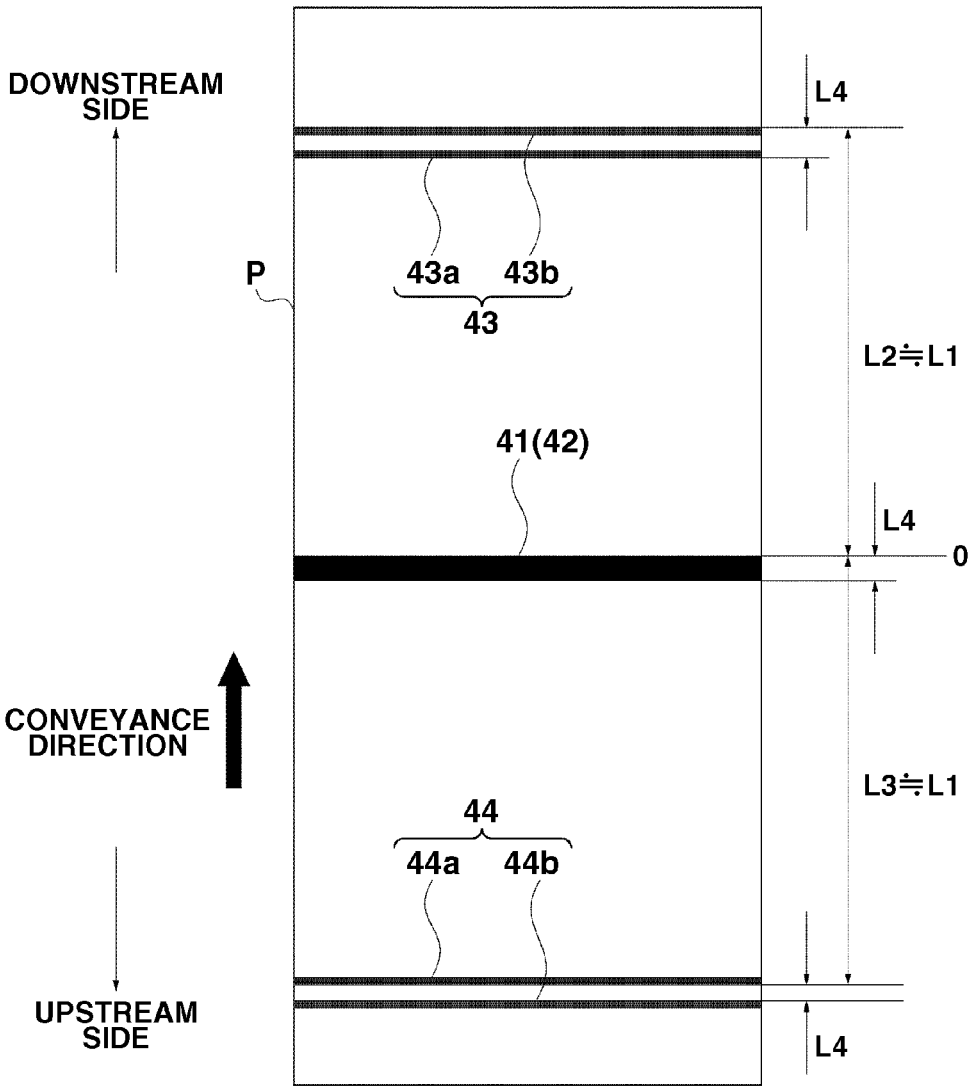
FIG. 5 illustrates a positional relationship between a splice portion and indentations.

FIG. 5 illustrates an extended state of the sheet P that has been pulled out of the roll $P_R$. The sheet P illustrated in FIG.

5 includes the splice portion 41 and two indentations 43 and 44 formed on the downstream side and the upstream side of the splice portion 41. The downstream indentation 43 is spaced from the splice portion 41 by a distance L2. The upstream indentation 44 is spaced from the splice portion 41 by a distance L3. The distance L2 and the distance L3 are substantially equal to an outer circumferential length L1 of the roll $P_R$ at the portion where the splice portion 41 is present. Therefore, in the following description, the above-described dimensions L1, L2, and L3 are regarded as satisfying a relationship L1=L2=L3.

In the present exemplary embodiment, the circumferential length L1 of the roll $P_R$ is equal to the length of a part of the sheet P that is pulled out of the roll $P_R$ while the roll $P_R$ makes one complete rotation in a state where the roll $P_R$ is held by the sheet holding device 1. A width L4 of the indentation 43 is defined by the distance between the upstream side step height 43*a* and the downstream side step height 43*b*. A width L4 of the indentation 44 is defined by the distance between the downstream side step height 44*a* and the upstream side step height 44*b*. The indentation 43, the indentation 44, and the tape 42 are substantially equal to each other in width (=L4).

Figure 6:
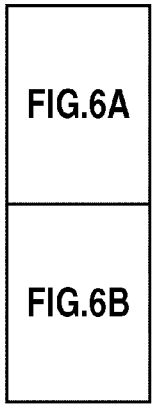
FIG. 6 is a flowchart illustrating an operational sequence of example processing that is performed by the control system of the recording apparatus according to the first exemplary embodiment of the present invention.
Figure 7:
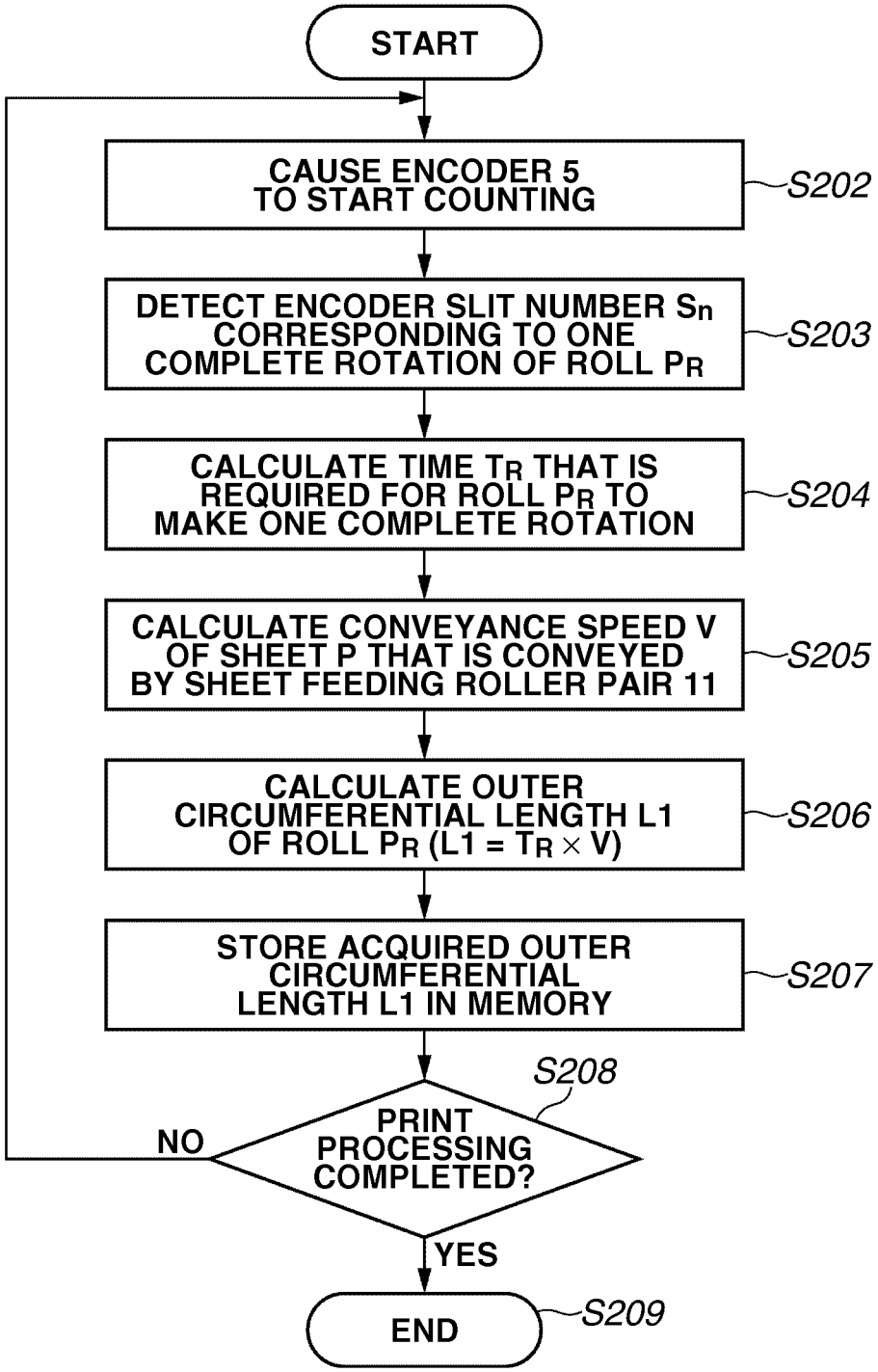
FIG. 7 is a flowchart illustrating an operational sequence of example processing that is performed by the control system of the recording apparatus according to the first exemplary embodiment of the present invention.

An example method for detecting the splice portion 41, the indentation 43, and the indentation 44 is described below in detail. Further, example sequences for controlling conveyance and print processing based on detection results are described below in detail. FIGS. 6 and 7 are flowcharts illustrating operational sequences of example processing that can be performed by the control unit 100 according to the first exemplary embodiment of the present invention.

In step S200, the control unit 100 receives a print instruction and starts a sheet conveyance operation (see step S201, step S211, and step S212). More specifically, in step S201, the control unit 100 drives the driving motor M1 to cause the roll $P_R$ to start rotating. In step S210, the control unit 100 causes the sheet feeding roller pair 11 to start rotating. In step S211, the control unit 100 causes the sheet sensor 14 to detect a front end of the sheet P while the sheet P is conveyed. In step S212, the control unit 100 calculates timing when the front end of the sheet P passes through a detection position of the splice sensor 13 based on detection information obtained by the sheet sensor 14.

In step S213, the control unit 100 causes the splice sensor 13 to start scanning the splice portion 41 when the calculated time comes. In step S214, the splice sensor 13 detects the splice portion 41. The control unit 100 acquires information relating to a position indicated by "0" (i.e., a position corresponding to a downstream side stepped portion of the tape 42) and the width L4 of the tape 42 illustrated in FIG. 5 based on a detection result. The splice sensor 13 is an optical sensor (e.g., a reflection type photo sensor) as described below. The splice sensor 13 can detect a change in quantity of reflection light that reflects a difference between the sheet P and the tape 42 in surface properties (reflectance of light) and also a step height of the tape 42.

Meanwhile, the control unit 100 performs processing of another routine illustrated in FIG. 7 to calculate the above-described outer circumferential length L1 of the roll $P_R$. The control unit 100 calculates the outer circumferential length L1 based on a rotational amount of the roll $P_R$ detected by the rotary encoder 5 and a conveyance speed of the sheet P.

In step S201, the control unit 100 causes the roll $P_R$ to start rotating. At the same time, in step S202, the control unit 100 causes the rotary encoder 5 to start counting. In step S203, the control unit 100 detects a count value of the rotary encoder 5 when it has reached an encoder slit number $S_n$ corresponding to one complete rotation of the roll $P_R$. In step S204, the control unit 100 calculates a time $T_R$ for the roll $P_R$ to make one complete rotation. In step S205, the control unit 100 calculates a conveyance speed V of the sheet P when the sheet P is conveyed by the sheet feeding roller pair 11.

The control unit 100 can calculate the conveyance speed V based on the rotational speed of the sheet feeding roller pair 11 and the total number of pulses having been input to the motor. Alternatively, the control unit 100 can calculate the conveyance speed V based on a rotational speed of other roller and the total number of pulses having been input to the motor. Then, in step S206, the control unit 100 calculates the outer circumferential length L1 of the roll $P_R$ using the time $T_R$ and the conveyance speed V (i.e., $L1=T_R \times V$). In the present exemplary embodiment, the rotational angle of the roll $P_R$ for the above-described measurement is not limited to one complete rotation (=360°) and can be any angle other than 360°.

In step S207, the control unit 100 stores the acquired outer circumferential length L1 in a memory of the control unit 100 (e.g., a storage area of the RAM 103). In step S208, the control unit 100 determines whether the print processing is completed. If it is determined that the print processing is not completed (NO in step S208), the control unit 100 repetitively performs the above-described processing for calculating and storing the values of $T_R$, V, and L1 (see step S202 through step S207) until completion of the print processing is confirmed.

In the present exemplary embodiment, information of the above-described remaining amount sensor 72 can be used to calculate the outer circumferential length L1 of the roll $P_R$. In this case, the control unit 100 obtains an outer diameter D of the roll $P_R$ based on a measurement value of the remaining amount sensor 72. Next, the control unit 100 calculates the outer circumferential length L1 of the roll $P_R$ using a calculation formula L1=nD. In the above-described case where the information of the remaining amount sensor 72 is used, the processing of steps S202 to S209 illustrated in FIG. 7 is replaced by the above-described calculation to obtain the outer circumferential length L1. According to this method, the outer circumferential length L1 can be quickly acquired even immediately after print processing is started.

Further, it is useful to acquire initial information relating to the outer circumferential length L1 of the roll $P_R$ that may be input by a user via the operation unit 104. For example, it is useful to store, beforehand in a memory, a data table that defines a relationship between each roll type and an outer circumferential length (or an outer diameter) of a roll in a brand-new condition to let a user input a roll type when the user sets a new roll $P_R$.

The control unit 100 can acquire information relating to the outer circumferential length of the new roll $P_R$ referring to the data table based on the input roll type. In any method, if the initial value of the outer circumferential length L1 of the roll is obtained, the control unit 100 can update a momentary value of the outer circumferential length L1 by estimating a reduction amount of the length L1 based on a sheet conveyance amount when the sheet is conveyed by the sheet conveyance mechanism.

Figure 6A:
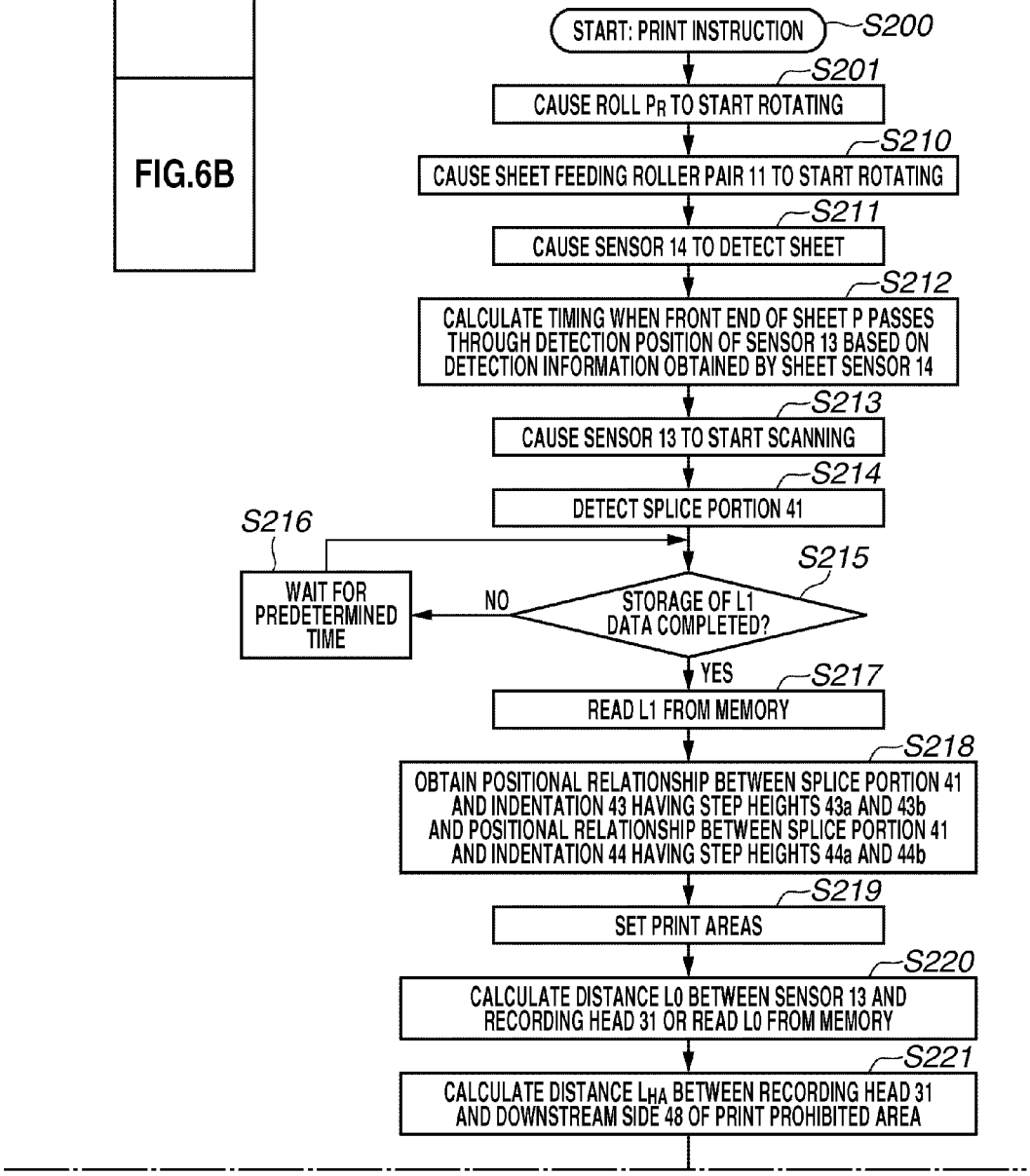
FIG. 6A is a flowchart illustrating the first part of the operational sequence.

Next, an example procedure for determining respective positions of the splice portion 41, the indentation 43, and the indentation 44 is described below in more detail. If the splice portion 41 is detected in step S214 of FIG. 6A, then in step S215, the control unit 100 confirms whether the outer circumferential length L1 is already stored in the memory through the processing of another routine illustrated in FIG. 7. If it is determined that the outer circumferential length L1 is not yet stored in the memory (NO in step S215), then in step S216, the control unit 100 waits for a predetermined time and repeats the confirmation processing in step S215.

If it is determined that the outer circumferential length L1 is already stored in the memory (YES in step S215), then in step S217, the control unit 100 reads information relating to the outer circumferential length L1 of the roll $P_R$ from the memory. In step S218, the control unit 100 obtains a positional relationship between the splice portion 41 and the indentation 43 having step heights 43*a* and 43*b* and a positional relationship between the splice portion 41 and the indentation 44 having step heights 44*a* and 44*b*, as illustrated in FIG. 5, based on the position information of the splice portion 41 and the information relating to the outer circumferential length L1 of the roll $P_R$.

Figure 8:
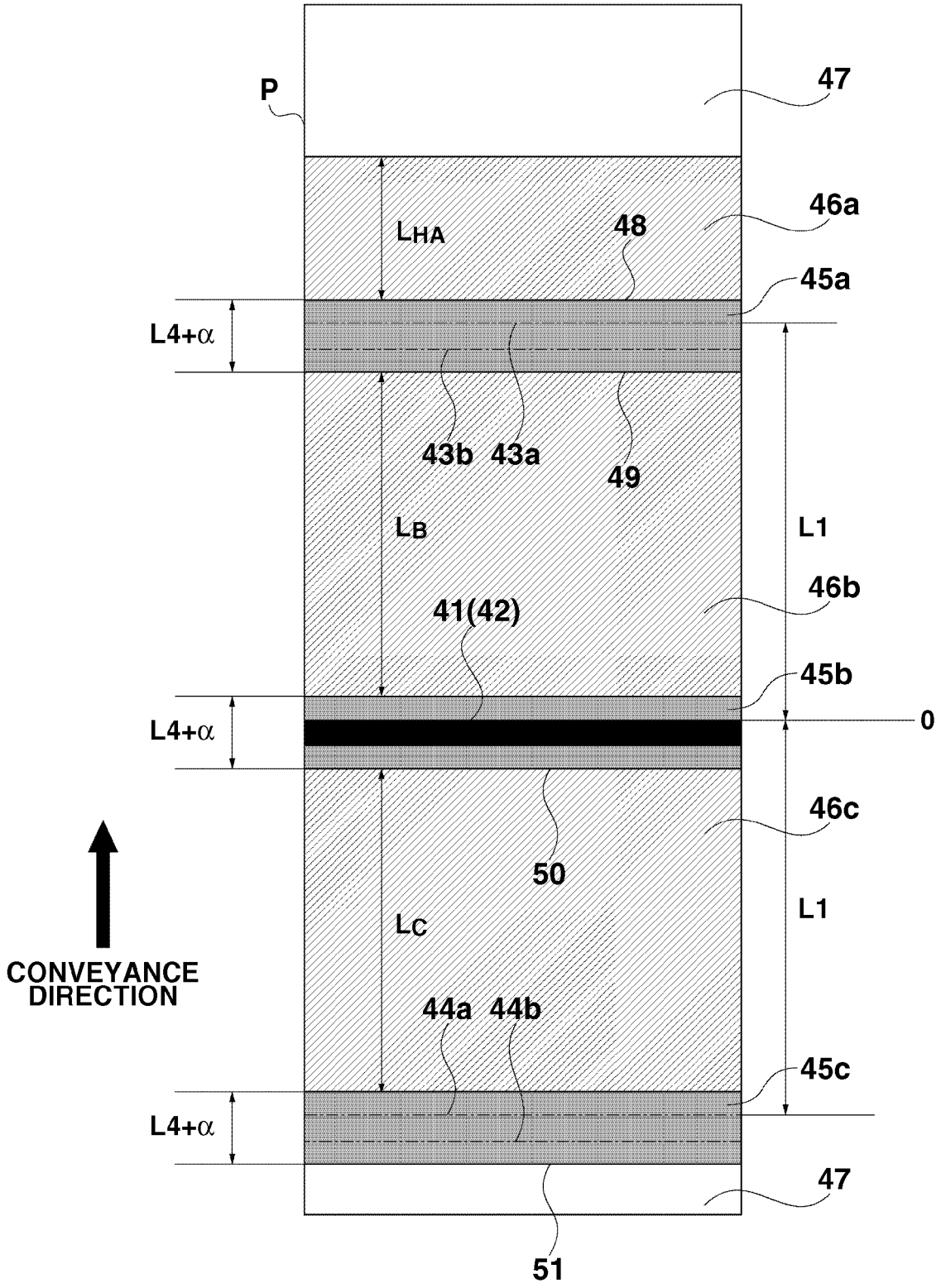
FIG. 8 illustrates an example setting of print areas.

In step S219, the control unit 100 sets a print prohibited area 45 (45*a*, 45*b*, and 45*c*), a print selectable area 46 (46*a*, 46*b*, and 46*c*), and a normal print area 47 on the sheet P, as illustrated in FIG. 8, based on the obtained positional relationship. The print prohibited area 45*b* is an area including the splice portion 41 (i.e., the tape 42 having a width L4) and its vicinity (i.e., upstream and downstream marginal portions each having a width of $\alpha/2$). Therefore, the print prohibited area 45*b* has a width of L4+$\alpha$. The margin width $\alpha$ is a value that can be determined beforehand considering positional errors and measurement errors, or can be a predetermined value, or can be set according to each measurement of sensor information.

The print prohibited area 45*a* is an area including the indentation 43 (having the width L4) and its vicinity (i.e., upstream and downstream marginal portions each having a width of $\alpha/2$). The print prohibited area 45*c* is an area including the indentation 44 (having the width L4) and its vicinity (i.e., upstream and downstream marginal portions each having a width of $\alpha/2$). Therefore, each of the print prohibited areas 45*a* and 45*c* has a width of L4+$\alpha$. The print prohibited area 45*a* is spaced from the print prohibited area 45*b* by a distance $L_B$ in the sheet conveyance direction. The print prohibited area 45*b* is spaced from the print prohibited area 45*c* by a distance Lc in the sheet conveyance direction. The distance $L_B$ is substantially equal to the distance $L_C$.

The control unit 100 performs a control for preventing the printing device 30 from recording an effective image at and in the vicinity of the splice portion (i.e., the print prohibited area 45*b*). Further, the control unit 100 performs a control for preventing the printing device 30 from recording an effective image at an upstream position and in the vicinity thereof (i.e., the print prohibited area 45*c*) that is spaced from the splice portion 41 by a distance corresponding to the outer circumferential length L1 of the roll. Similarly, the control unit 100 performs a control for preventing the printing device 30 from recording an effective image at a downstream position and in the vicinity thereof (i.e., the print prohibited area 45*a*) that is spaced from the splice portion 41 by a distance corresponding to the outer circumferential length L1 of the roll.

In the following description of the present exemplary embodiment, the "effective image" is an image that is finally printed on a sheet based on image data input via an image input apparatus or transmitted from an external computer and can be visually observed by a user. In this respect, the "effective image" according to the present exemplary embodiment does not include any mark in a marginal space that may be intentionally added by a recording apparatus or any ink print formed by a recording apparatus that performs a preliminary discharge operation.

The print selectable area 46 (46*a*, 46*b*, and 46*c*) is settable as an area in which the printing device 30 can print an effective image. In this respect, the print prohibited area 45 is an area excluded from the print selectable area 46 (46*a*, 46*b*, and 46*c*). If the size of an effective image to print is large or if there is any other reason, printing in the print selectable area 46 may not be performed and may be prohibited.

The normal print area 47 is an area where no splice portion is provided and effective images can be successively printed. In general, a very small portion of the continuously elongated sheet P is the splice and a greater part of a continuously elongated sheet P is the normal print area 47.

Figure 9:
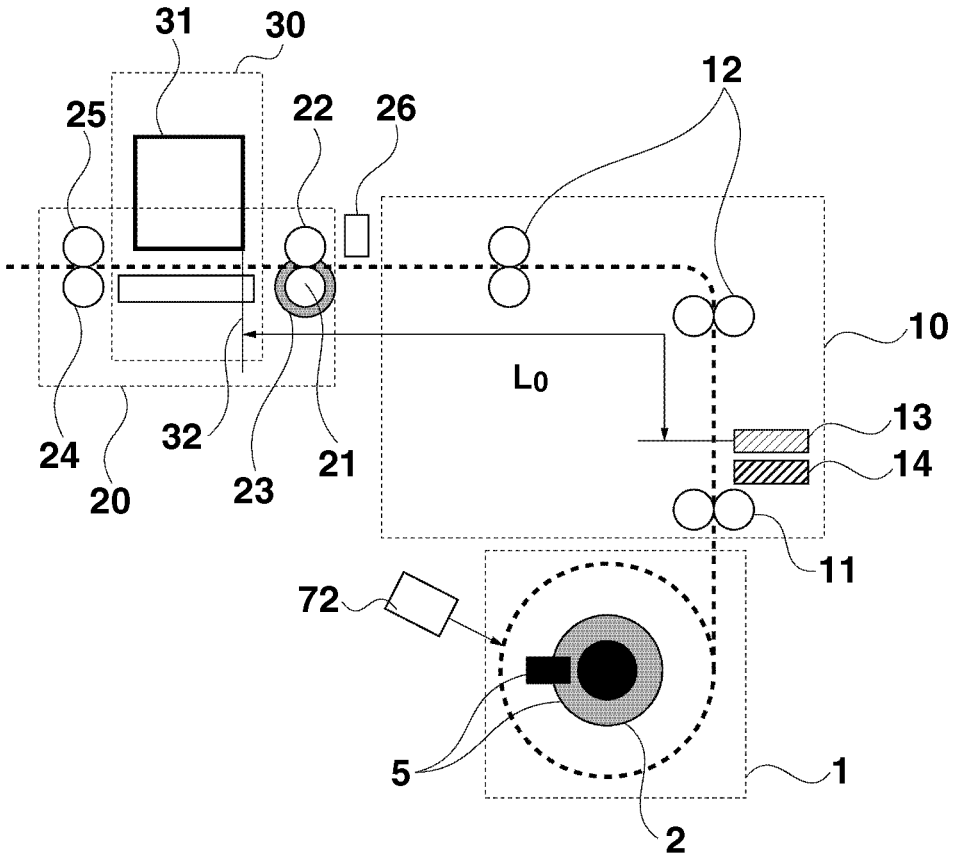
FIG. 9 illustrates a positional relationship between a splice sensor and a recording head.

Next, an example procedure of a print operation control to be performed after completing the above-described area setting is described below in more detail. As illustrated in FIG. 9, a distance $L_0$ represents a conveyance path extending from the detection position of the splice sensor 13 to a print start position 32 of the recording head 31.

To avoid any print at an indentation on the downstream side of a splice portion, the distance $L_0$ is greater than the outer circumferential length L1 of a brand-new roll of the sheet P that has the largest roll diameter among various sheet rolls usable in the recording apparatus. For example, in an exemplary embodiment, the distance $L_0$ is greater than a length comparable to two times the outer circumferential length L1 of the roll of the sheet P having the largest roll diameter among various sheet rolls usable in the recording apparatus (i.e., L1×2).

In step S220, the control unit 100 measures the distance $L_0$ as a shifting length of the front end of the sheet P while the sheet P is conveyed from the splice sensor 13 to the print start position 32 of the recording head 31. More specifically, the distance $L_0$ is equal to a sum of the following values (1) to (3).

(1) A distance between two sheet sensors 14 and 26 calculated based on a time difference in detection of the sheet P by the sheet sensors 14 and 26 and the conveyance speed of the sheet P.

(2) A designed distance between the detection position of the sheet sensor 14 and the detection position of the splice sensor 13.

(3) A designed distance from the detection position of the sheet sensor 26 to the print start position 32.

As the distance $L_0$ is a fixed value determined in a design process, it is useful to store a preliminarily measured or designed value in a memory so that the control unit 100 can read the stored value from the memory. In this case, the above-described processing for measuring the distance $L_0$ can be skipped.

Figure 10:
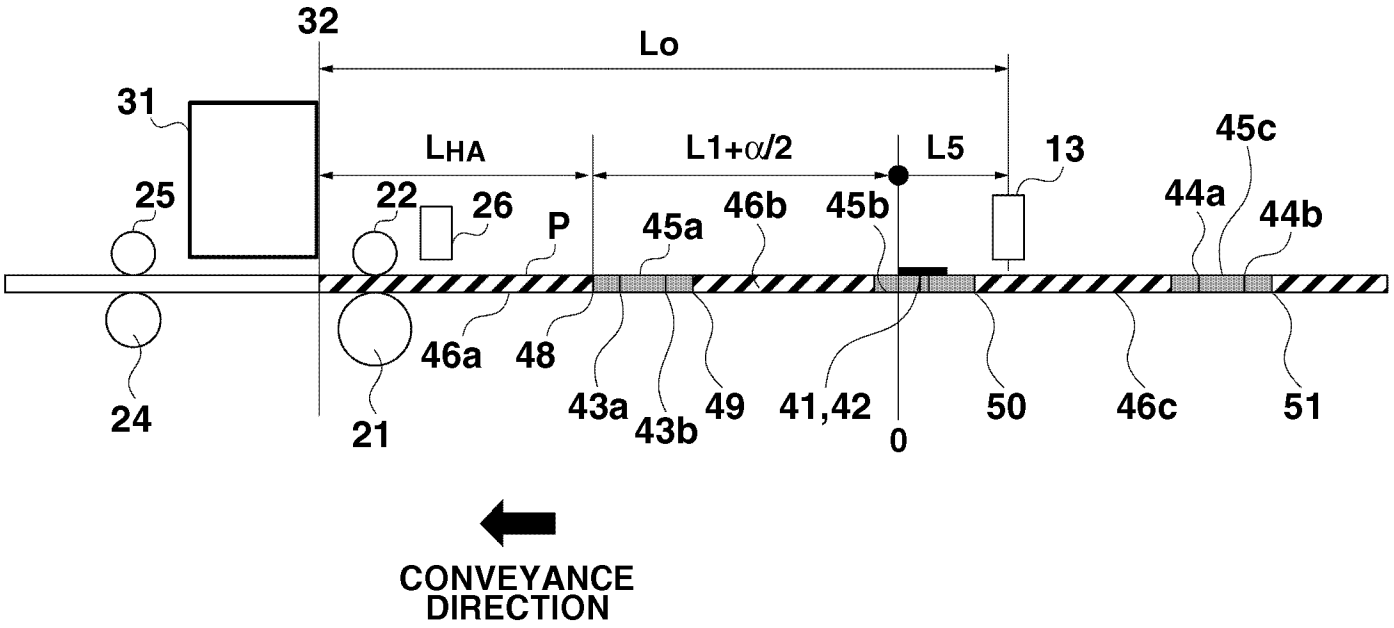
FIG. 10 illustrates a positional relationship between the recording head and a sheet.

Next, as illustrated in FIG. 10, the control unit 100 calculates the distance $L_0$ of the conveyance path and a moving distance L5 until the positions of the splice portion 41, the indentation 43, and the indentation 44 are determined. In step S221, the control unit 100 calculates a distance $L_{HA}$ between the print start position 32 of the recording head 31 and a downstream side 48 of the downstream side print prohibited area 45*a*. The control unit 100 can calculate the distance $L_{HA}$ using the following formula.

$$L_{HA}=L_0-(L5+L1+\alpha/2)$$

Then, in step S222, the control unit 100 determines whether the print processing is in progress by checking whether the front end of the sheet P has passed through the print start position 32 of the recording head 31 at the time when respective positions are determined as described above. If it is determined that the print processing is in progress (YES in step S222), the processing proceeds to S223. If it is determined that the print processing is not started yet (NO in step S222), the processing proceeds to step S228.

The recording apparatus performs printing based on an image data group including at least one effective image having a size (length) $L_{R0}$ in the sheet conveyance direction (for example, image data corresponding to 50 sheets of L-size photo print). A length $L_E$ is a clearance (marginal space) between two neighboring images. The cutting device 40 cuts continuously connected sheets at their marginal portions into independent cut sheets.

Figure 11:
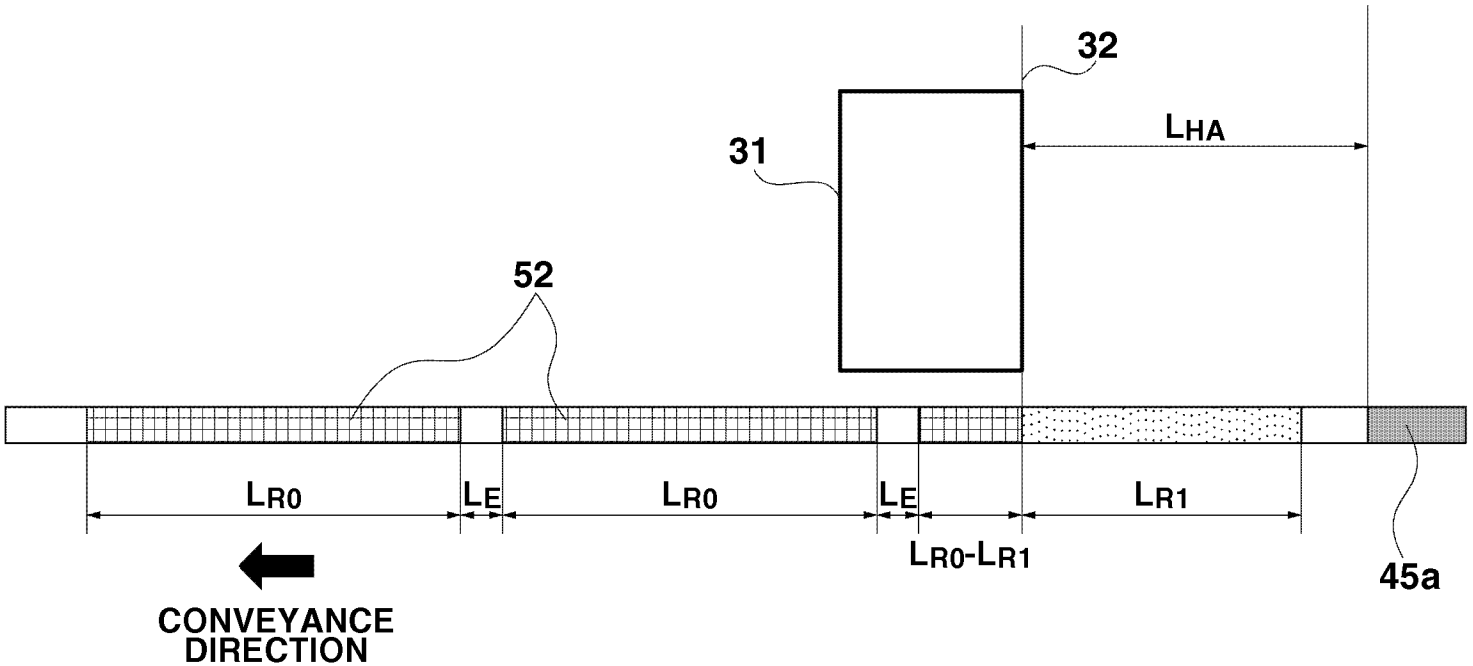
FIG. 11 illustrates a positional relationship between the recording head and a sheet.

Example processing to be performed when the print processing is in progress (YES in step S222) is described below. In step S223, the control unit 100 determines whether a remaining length $L_{R1}$ of an unprinted area (see FIG. 11) is longer than the distance $L_{HA}$ in a state where one effective image having a length $L_{R0}$ is currently recorded. If it is determined that the remaining length $L_{R1}$ is longer than the distance $L_{HA}$ (YES in step S223), then in step S224, the control unit 100 causes the printing device 30 to interrupt print processing currently performed in the print selectable area 46*a* (see FIG. 8) to prevent the printed image from extending over the print selectable area 46*a* into the print prohibited area 45*a*.

As a result, a print interrupted image becomes a defective print. In step S225, the control unit 100 causes the output unit 105 to display a warning message indicating the presence of a defective print in a printed output product. In a case where the recording apparatus performs processing for adding a number "xxxxxx" for each sheet (e.g., xxxxxx.jpg), the output unit 105 also displays a print number of the defective sheet. For example, the output unit 105 displays a warning message "print of xxxxxx.jpg is defective."

In this case, a user confirms the warning message, and can remove a printed output product including the defective print. In step S226, the control unit 100 adds image data of the detected defective image to the tail of sequential processing of print jobs to cause the printing device 30 to restart the printing. As described above, the recording apparatus interrupts the print processing if it is determined that any defective print may be produced. Therefore, the present exemplary embodiment can reduce the consumption of inks used by the recording apparatus.

If an indentation formed on a sheet is not so large, the product may be regarded as a non-defective product. Hence, according to another example embodiment, the control unit 100 can cause the printing device 30 to continuously perform printing in the print prohibited area 45*a* without stopping the image formation performed by the recording head 31. In this case, it is useful to cause the output unit 105 to generate a warning message indicating that a printed output product may be defective. A user can finally determine whether the printed output product is defective or non-defective by actually confirming the printed output product referring to the print number displayed by the warning.

On the other hand, if it is determined that the remaining length (i.e., unprinted image length) $L_{R1}$ is equal to or shorter than the distance $L_{HA}$ (NO in step S223), then in step S227, the control unit 100 causes the printing device 30 to continuously perform printing by an amount corresponding to the remaining length $L_{R1}$, thereby completing print processing of one complete image. In this case, an extra region may remain in the print selectable area 46*a*, which is sufficient for the recording head 31 to further print another image (see FIG. 8).

Hence, the control unit 100 calculates a number of sheets that are printable in the print selectable area 46*a* using a calculation formula $(L_{HA}-L_{R1})/(L_{R0}+L_E)$. In this case, an integer part of the value obtained through the calculation is the number of printable sheets. Therefore, in step S227, the control unit 100 causes the printing device 30 to print images of the calculated number of sheets in the print selectable area 46*a*. For example, if $(L_{HA}-L_{R1})$=300 mm, $L_{R0}$=127 mm (L size) and $L_E$=10 mm, the control unit 100 can obtain a value 2.18 (=300/137) through the above-described calculation. In this case, the printing device 30 prints two images corresponding to the integer part.

Example processing to be performed when the print processing is not yet started (NO in step S222) is described below. In step S228, the control unit 100 determines whether the length $L_{R0}$ of the effective image to be printed is longer than the distance $L_{HA}$. If it is determined that the length $L_{R0}$ of the effective image is longer than the distance $L_{HA}$ (YES in step S228), then in step S229, the control unit 100 prevents the printing device 30 from performing printing in the print selectable area 46*a*, thereby preventing the printed image from extending over the print selectable area 46*a* into the print prohibited area 45*a*.

If it is determined that the length $L_{R0}$ of the effective image is equal to or shorter than the distance $L_{HA}$ (NO in step S228), the printing device 30 can print one or more images in the print selectable area 46*a*. Hence, the control unit 100 calculates a number of sheets printable in the print selectable area 46*a* using a calculation formula $L_{HA}/(L_{R0}+L_E)$. In this case, an integer part of the value obtained through the calculation is the number of printable sheets. Then, the control unit 100 causes the printing device 30 to perform printing of images corresponding to the calculated number of sheets in the print selectable area 46*a*.

In step S230, the control unit 100 prevents the printing device 30 from performing printing in the print prohibited area 45*a* (i.e., the following sheet area), and causes the sheet conveyance device 20 to convey the sheet P forward. Then, the control unit 100 causes the printing device 30 to resume the printing at timing when an upstream end 49 of the print prohibited area 45*a* reaches the print start position 32. Then, in step S231, the control unit 100 determines whether the length $L_{R0}$ of the effective image is longer than a length $L_B$ of the print selectable area 46*b*.

If it is determined that the length $L_{R0}$ of the effective image is longer than the length $L_B$ of the print selectable area 46*b* (YES in step S231), then in step S232, the control unit 100 determines that one complete image is unprintable in the print selectable area 46*b*. Therefore, the control unit 100 prevents the printing device 30 from performing printing in the print selectable area 46*b*, and causes the sheet conveyance device 20 to convey the sheet P forward. On the contrary, if it is determined that the length $L_{R0}$ of the effective image is equal to or shorter than the length $L_B$ of the print selectable area 46*b* (NO in step S231), then the control unit 100 determines that one or more images are printable in the print selectable area 46*b*. Therefore, the control unit 100 calculates a number of sheets printable in the print selectable area 46*b* using a calculation formula $L_B/L_{R0}$. In this case, an integer part of the value obtained through the calculation is the number of printable sheets. Then, in step S233, the control unit 100 causes the printing device 30 to perform printing of images corresponding to the calculated number of sheets in the print selectable area 46*b*.

In step S234, the control unit 100 prevents the printing device 30 from performing printing in the print prohibited area 45*b* that includes the splice portion 41 (i.e., the following sheet area), and causes the sheet conveyance device 20 to convey the sheet P forward. Then, the control unit 100 causes the printing device 30 to resume the printing at timing when an upstream end 50 of the print prohibited area 45*b* reaches the print start position 32. In step S235, the control unit 100 determines whether the length $L_{R0}$ of the effective image is longer than a length $L_C$ of the print selectable area 46*c*.

If it is determined that the length $L_{R0}$ of the effective image is longer than the length $L_C$ of the print selectable area 46*c*

(YES in step S235), then in step S236, the control unit 100 prevents the printing device 30 from performing printing in the print selectable area 46*c*, and causes the sheet conveyance device 20 to convey the sheet P forward because one complete image is unprintable in the print selectable area 46*c*. On the contrary, if it is determined that the length $L_{R0}$ of the effective image is equal to or shorter than the length $L_C$ of the print selectable area 46*c* (NO in step S235), one or more images are printable in the print selectable area 46*c*. Therefore, the control unit 100 calculates a number of sheets printable in the print selectable area 46*c* using a calculation formula $L_C/L_{R0}$. In this case, an integer part of the value obtained through the calculation is the number of printable sheets. Then, in step S237, the control unit 100 causes the printing device 30 to perform printing of images corresponding to the calculated number of sheets in the print selectable area 46*c*.

Figure 6B:
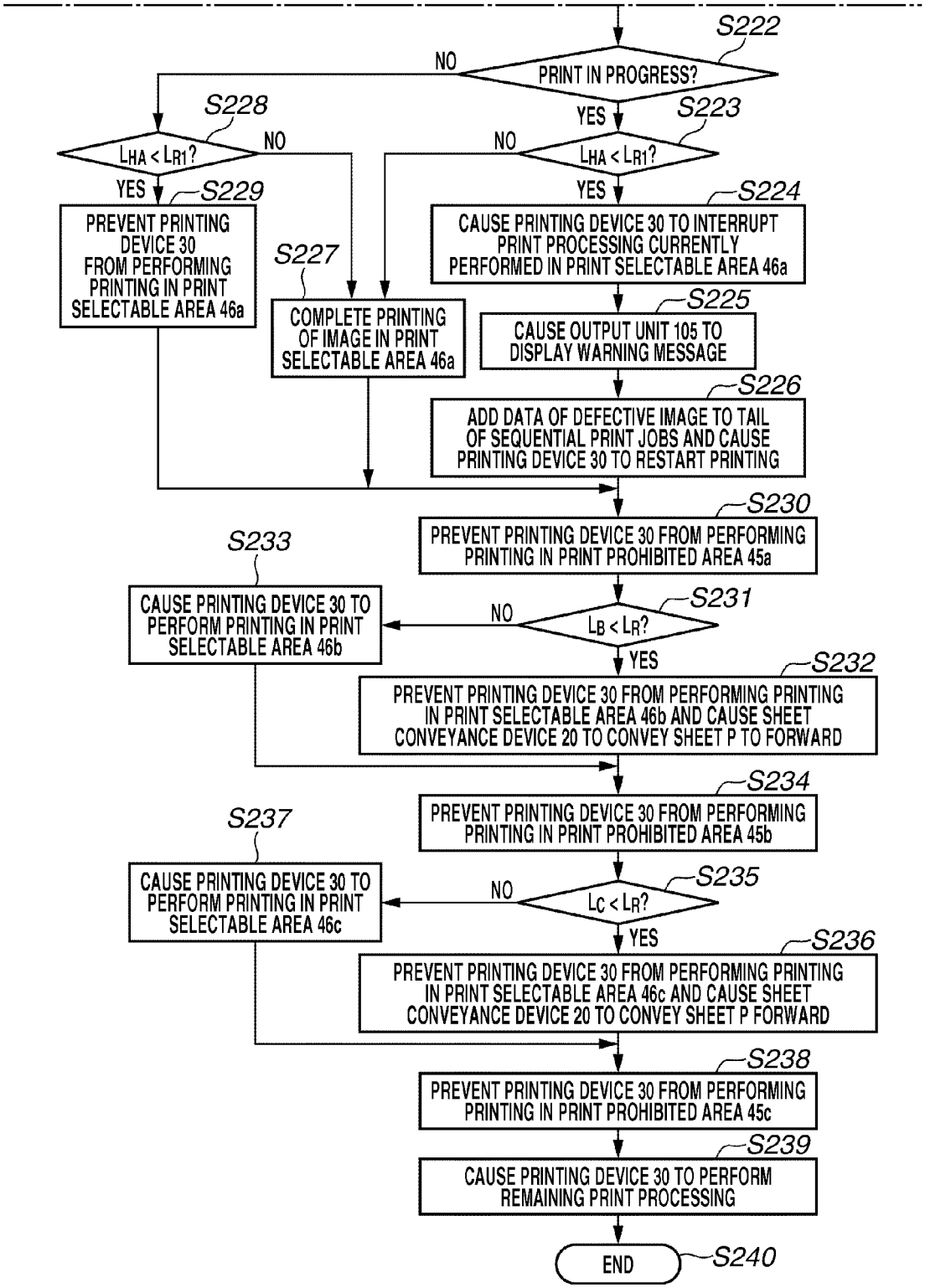
FIG. 6B is a flowchart illustrating the second part of the operational sequence.

In step S238, the control unit 100 prevents the printing device 30 from performing printing in the print prohibited area 45*c* (i.e., the following sheet area) of the sheet P. The control unit 100 causes the sheet conveyance device 20 to convey the sheet P forward. Then, the control unit 100 causes the printing device 30 to resume the printing at timing when an upstream end 51 of the print prohibited area 45*c* reaches the print start position 32. Then, in step S239, the control unit 100 causes the printing device 30 to perform remaining print processing (i.e., perform printing in the normal print area 47). In step S240, the control unit 100 terminates the print processing routine illustrated in FIG. 6B.

As described above, the recording apparatus according to the present exemplary embodiment can prevent an effective image from being printed in an area corresponding to the splice portion 41, and can also prevent an effective image from being printed in an area corresponding to the indentations 43 and 44 formed on the upstream side and the downstream side of the splice portion 41. Therefore, the present exemplary embodiment can prevent a recording apparatus from performing printing at a portion influenced (deformed) by a splice portion when a roll of continuously connected sheets is used, thereby reducing the amount of defective products.

Further, even in the case where the recording apparatus performs printing at the portion influenced (deformed) by the splice portion, the recording apparatus generates a warning to enable users to easily recognize a generated defective product.

When the recording apparatus acquires information relating to the outer circumferential length L1 of the roll $P_R$ described in the first exemplary embodiment, print processing may have been already started in the print prohibited area 45*a* depending on the layout of the recording apparatus. For example, the recording apparatus may be in the above-described situation in a case where the distance $L_0$ between the splice sensor 13 and the print start position 32 is shorter than the outer circumferential length L1 of the roll $P_R$ ($L_0$<L1) due to the configuration of a sheet conveyance path provided in a space of the recording apparatus. More specifically, the recording apparatus may be in the above-described situation if a relationship $L_0-(L5+\alpha/2)<L1$ is satisfied.

Figure 12:
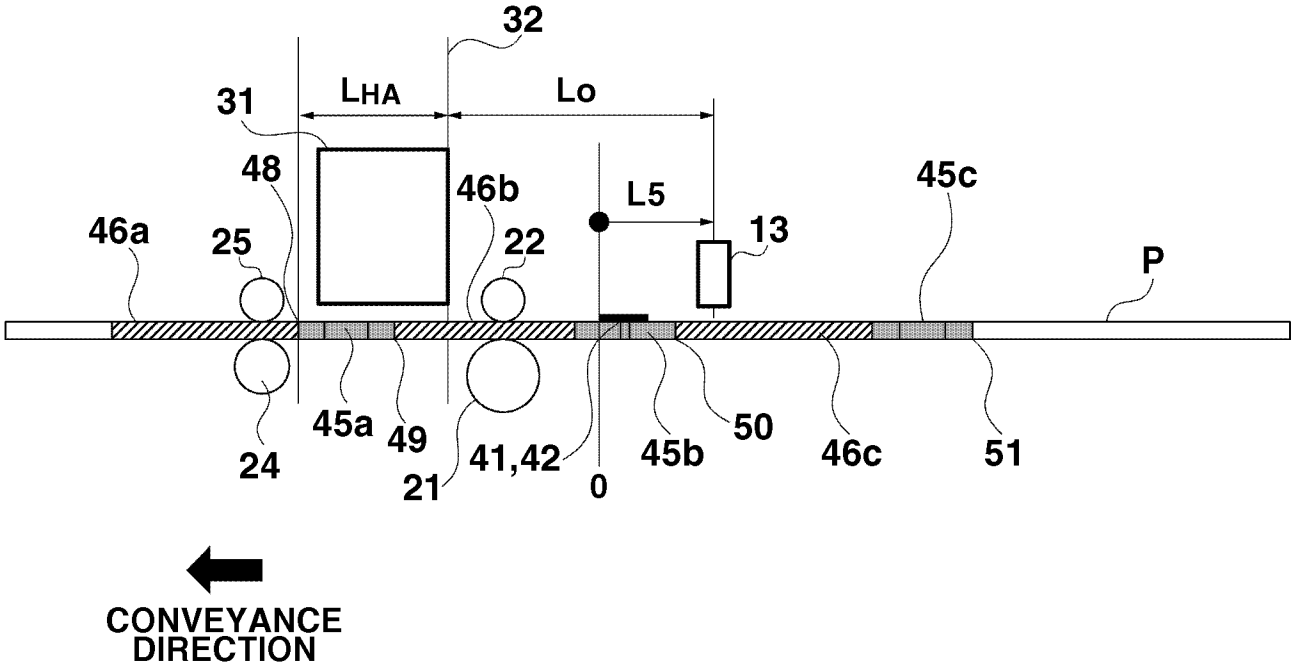
FIG. 12 illustrates a positional relationship between the recording head and a sheet according to a second exemplary embodiment of the present invention.
Figure 13:
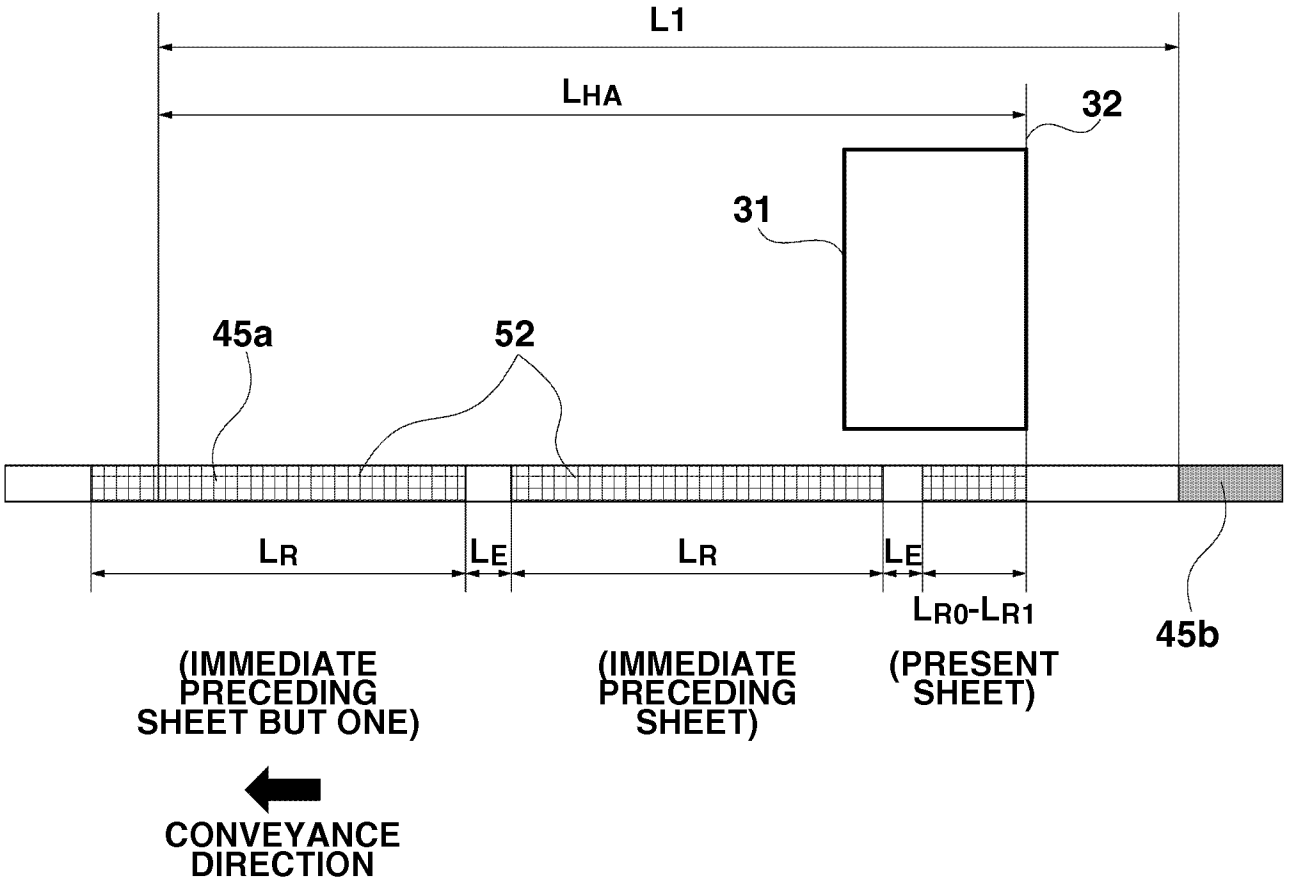
FIG. 13 illustrates a positional relationship between the recording head and a sheet.
Figure 14:
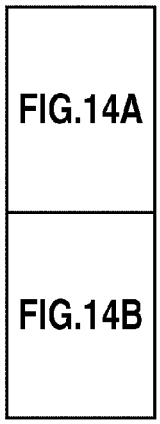
FIG. 14 is a flowchart illustrating an operational sequence of example processing that is performed by the control system of the recording apparatus according to the second exemplary embodiment of the present invention.

FIG. 12 is a view schematically illustrating a positional relationship between the recording apparatus and the sheet P at the time when setting of the image areas is completed based on the identified positional information of the splice portion 41, the indentation 43, and the indentation 44. FIG. 13 is a view schematically illustrating a positional relationship between the recording head 31 and the sheet P when the recording apparatus is in the state illustrated in FIG. 12. FIG. 14, including FIG. 14A and FIGS. 14B, and 15 are flowcharts illustrating operational sequences of example processing that can be performed by the control unit 100 according to a second exemplary embodiment of the present invention.

Figure 14A:
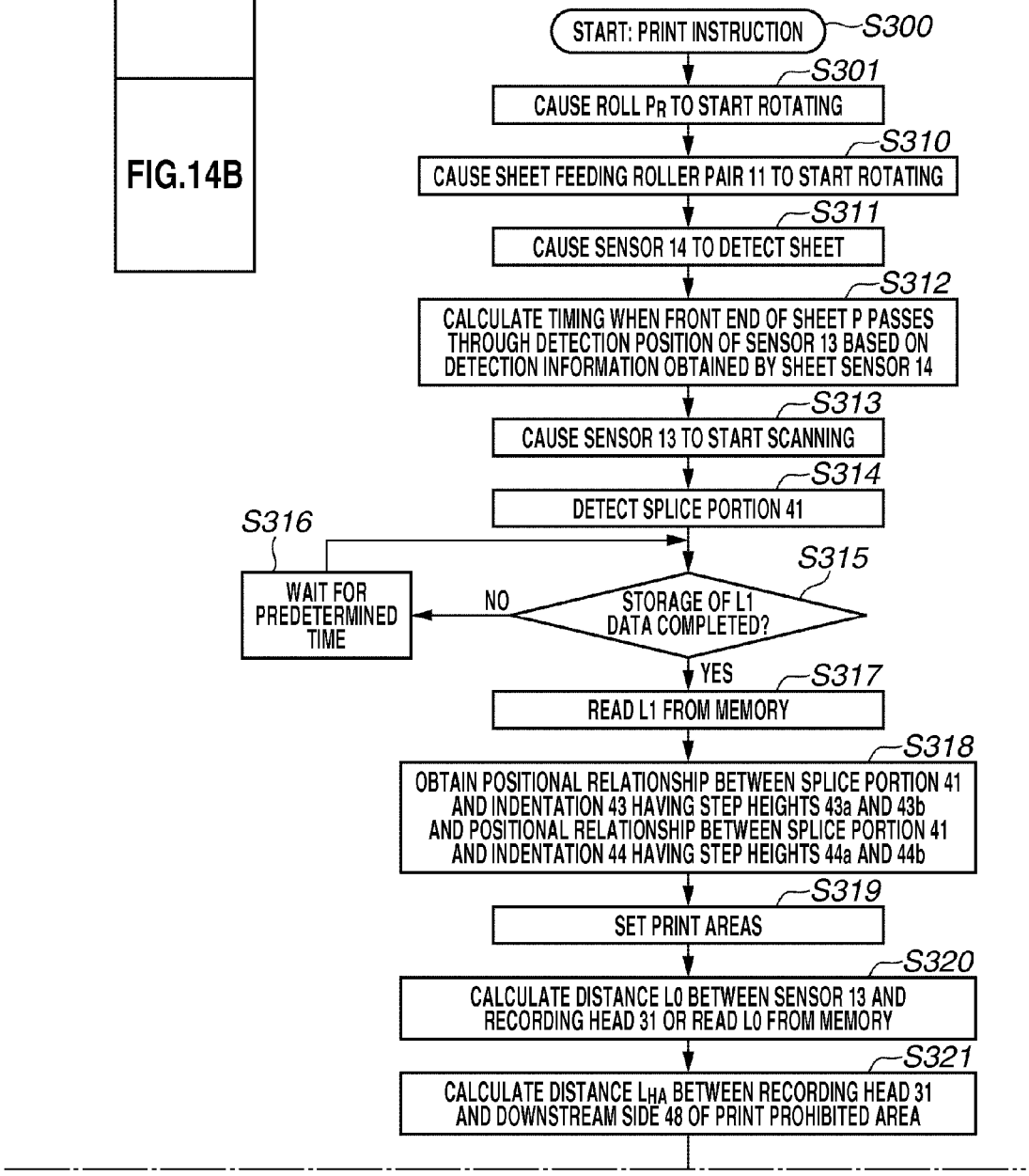
FIG. 14A is a flowchart illustrating the first part of the operational sequence.
Figure 14B:
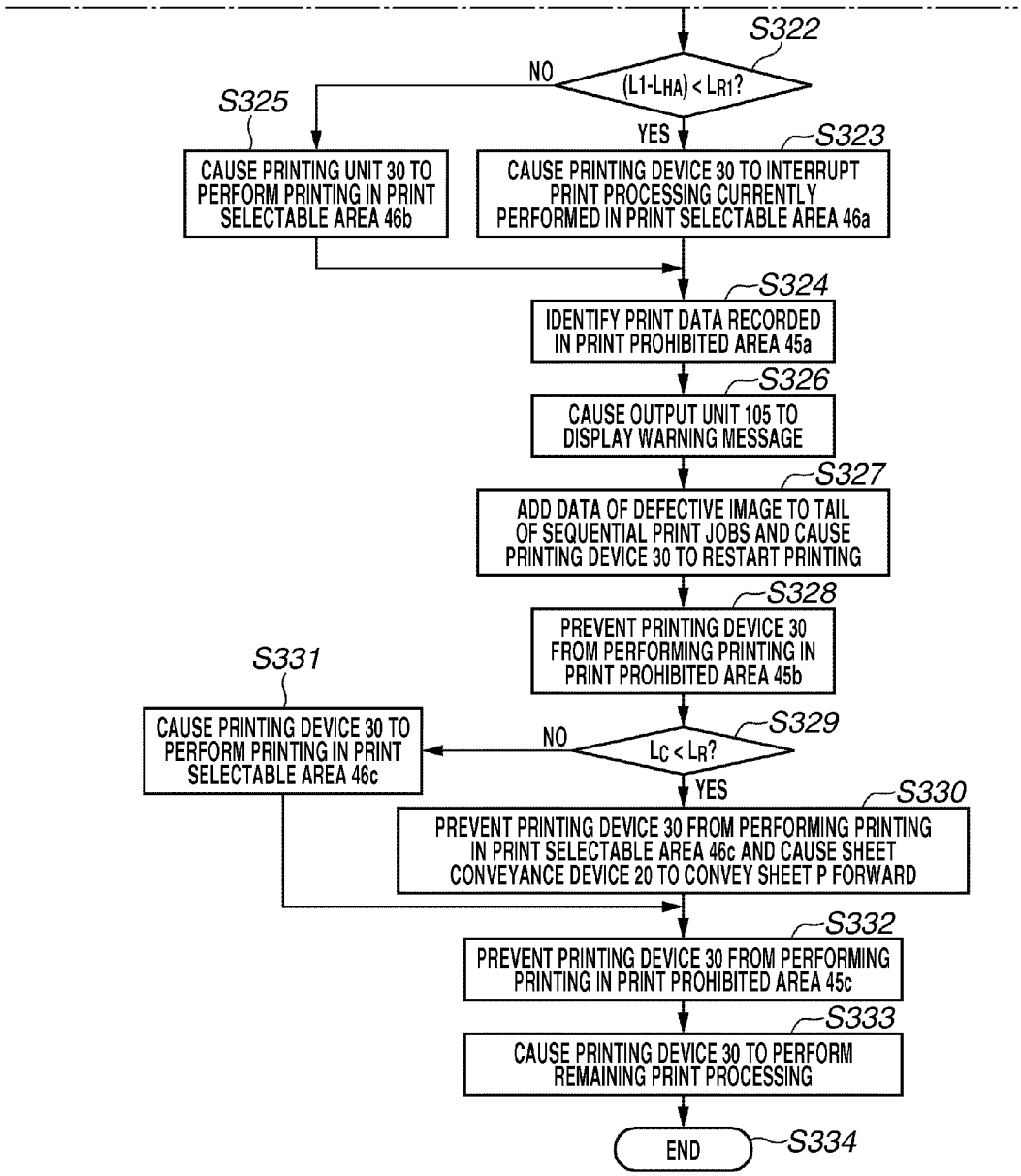
FIG. 14B is a flowchart illustrating the second part of the operational sequence.
Figure 15:
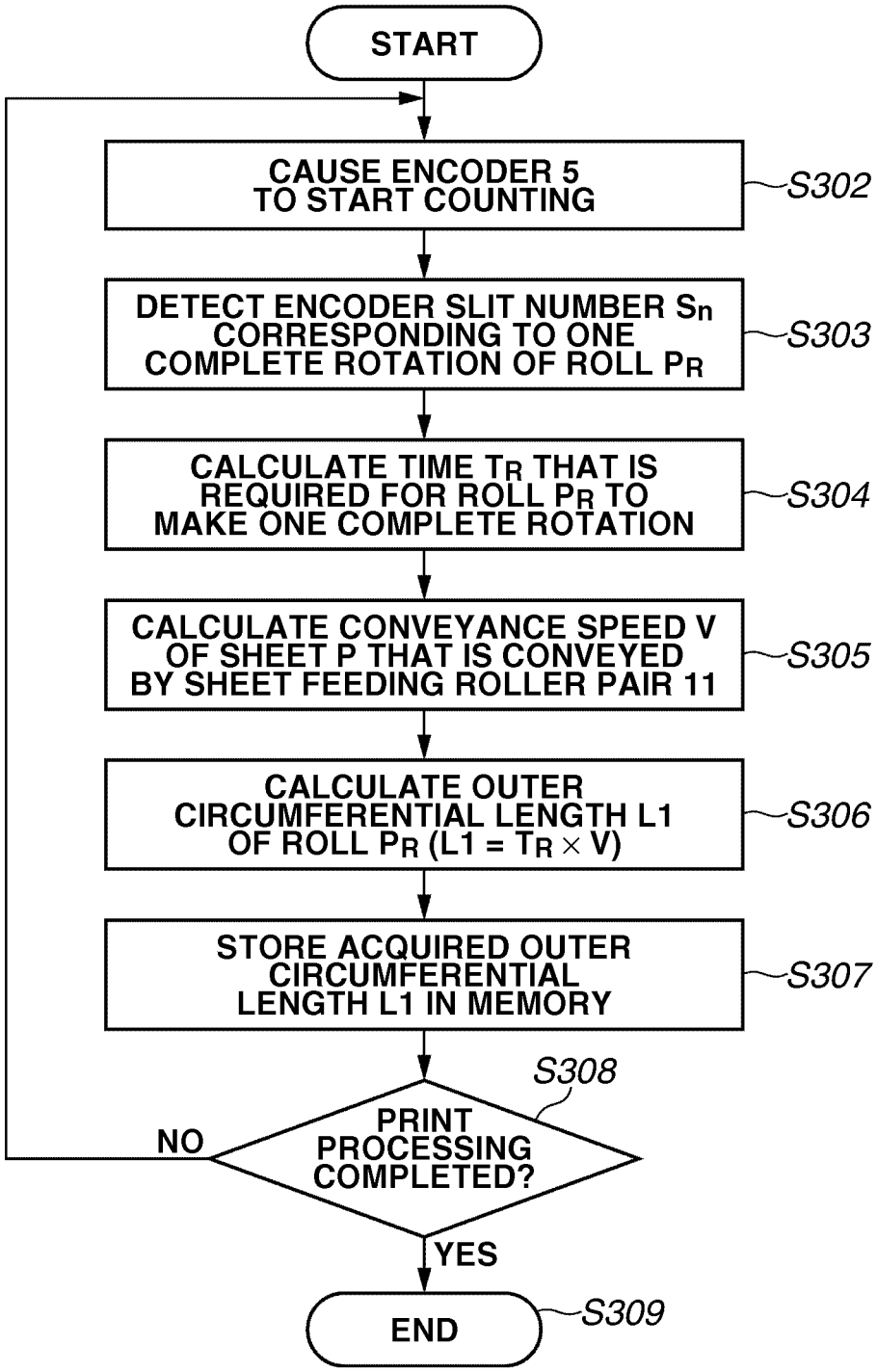
FIG. 15 is a flowchart illustrating an operational sequence of example processing that is performed by the control system of the recording apparatus according to the second exemplary embodiment of the present invention.

In FIGS. 14A, 14B, and 15, processing to be performed in steps S300 to S321 and processing to be performed in steps S328 to S333 are similar to the above-described processing performed in steps S200 to S212 and steps S234 to S240 illustrated in FIG. 7. Therefore, similar descriptions for the processing to be performed in steps S300 to S321 and steps S328 to S333 are not repeated. Further, as described in the first exemplary embodiment, a processing routine illustrated in FIG. 15 including steps S302 to S307 can be replaced by the calculation method using the remaining amount sensor 72 to obtain the outer circumferential length L1 of the roll $P_R$.

The present exemplary embodiment is applicable to a recording apparatus that aims to reduce the distance $L_0$ to downsize the apparatus body. Accordingly, as illustrated in FIG. 12, printing in the print prohibited area 45*a* is already started by the recording head 31 at the time when the setting of the print areas is completed.

In step S322, the control unit 100 compares a distance ($L1-L_{HA}$) between the print start position 32 and the print prohibited area 45*b* with the unprinted image length $L_{R1}$ (see FIG. 13). More specifically, the control unit 100 checks whether there is a sufficient space for the recording head 31 to complete the printing before the recording head 31 reaches the print prohibited area 45*b*. If it is determined that the distance ($L1-L_{HA}$) is shorter than the unprinted image length $L_{R1}$, i.e., $(L1-L_{HA})<L_{R1}$ (YES in step S322), then in step S323, the control unit 100 causes the recording head 31 to immediately stop the ink discharge operation.

On the other hand, if it is determined that the distance ($L1-L_{HA}$) is equal to or longer than the unprinted image length $L_{R1}$, i.e., $(L1-L_{HA})\geq L_{R1}$ (NO in step S322), then in step S325, the control unit 100 causes the printing device 30 to continuously perform printing by an amount corresponding to the unprinted image length $L_{R1}$ because a sufficient sheet space remains for the recording head 31 to complete the printing before the recording head 31 reaches the print prohibited area 45*b*. In this case, the recording head 31 may be able to further print another image in the print selectable area 46*b*.

Hence, the control unit 100 calculates a number of sheets that are printable in the print selectable area 46*b* using a calculation formula $(L1-L_{HA}-L_{R1})/(L_{R0}+L_E)$. In this case, an integer part of the value obtained through the calculation is the number of printable sheets. Then, in step S325, the control unit 100 causes the printing device 30 to perform printing of images corresponding to the calculated number of sheets in the print selectable area 46*b*. For example, if $(L1-L_{HA}-L_{R1})$ =300 mm, $L_{R0}$=127 mm (L size), and $L_E$=10 mm, the control unit 100 obtains a value 2.18 (=300/137) through the above-described calculation. Therefore, the printing device 30 prints two images corresponding to the integer part of the calculated value.

Next, in step S324, the control unit 100 identifies print data recorded in the print prohibited area 45*a* based on the values of $L_{HA}$, $L_{R0}$, and $L_{R1}$. To perform the processing of step S324, the control unit 100 can refer to an image whose print processing is performed or started when the setting of the print areas is completed and can calculate a value using a calculation formula $L_{HA}-(L_{R0}-L_{R1})/(L_{R0}+L_E)$.

For example, if $L_{HA}$=300 mm, $L_{R1}$=40 mm, $L_{R0}$=127 mm, and $L_E$=10 mm, the control unit 100 can obtain a value 1.55 (=(300-87)/(127+10)) through the above-described calculation. Therefore, it is understood that an immediately preceding image that corresponds to an integer part of the calculated value includes a print prohibited area. Therefore, in step S326, the control unit 100 causes the output unit 105 to display a warning message indicating the presence of a defective part in a printed output product.

In a case where the recording apparatus performs processing for adding a number "xxxxxx" for each sheet (e.g., xxxxxx.jpg), the output unit 105 can also display a print number of the defective print. For example, the output unit 105 displays a warning message "print of xxxxxx.jpg may be defective." A user can confirm a printed output product referring to a displayed print number of the defective print. Then, the user can remove the printed output product if any defectiveness is confirmed and can leave the printed output product if no defectiveness is confirmed.

In step S327, the control unit 100 adds image data corresponding to the detected defective image to the tail of sequential processing of print jobs to cause the printing device 30 to restart the printing. Subsequently, the processing proceeds to step S328. The control unit 100 performs processing similar to the processing of step S234 and subsequent steps having been described in the above-described first exemplary embodiment (see FIG. 6B), although their descriptions are not repeated.

According to the present exemplary embodiment, the recording apparatus can be further downsized. Further, the recording apparatus according to the present exemplary embodiment can surely prevent an effective image from being printed in a print prohibited area including a splice portion or an indentation formed on at least an upstream side of the splice portion.

If the sheet P is too thin to have sufficient rigidity, and in a case where the tape 42 has a relatively large thickness, the tape 42 will form an indentation on a sheet surface not only during the first rotation of the roll but also during the second and subsequent n rotations.

Figure 16:
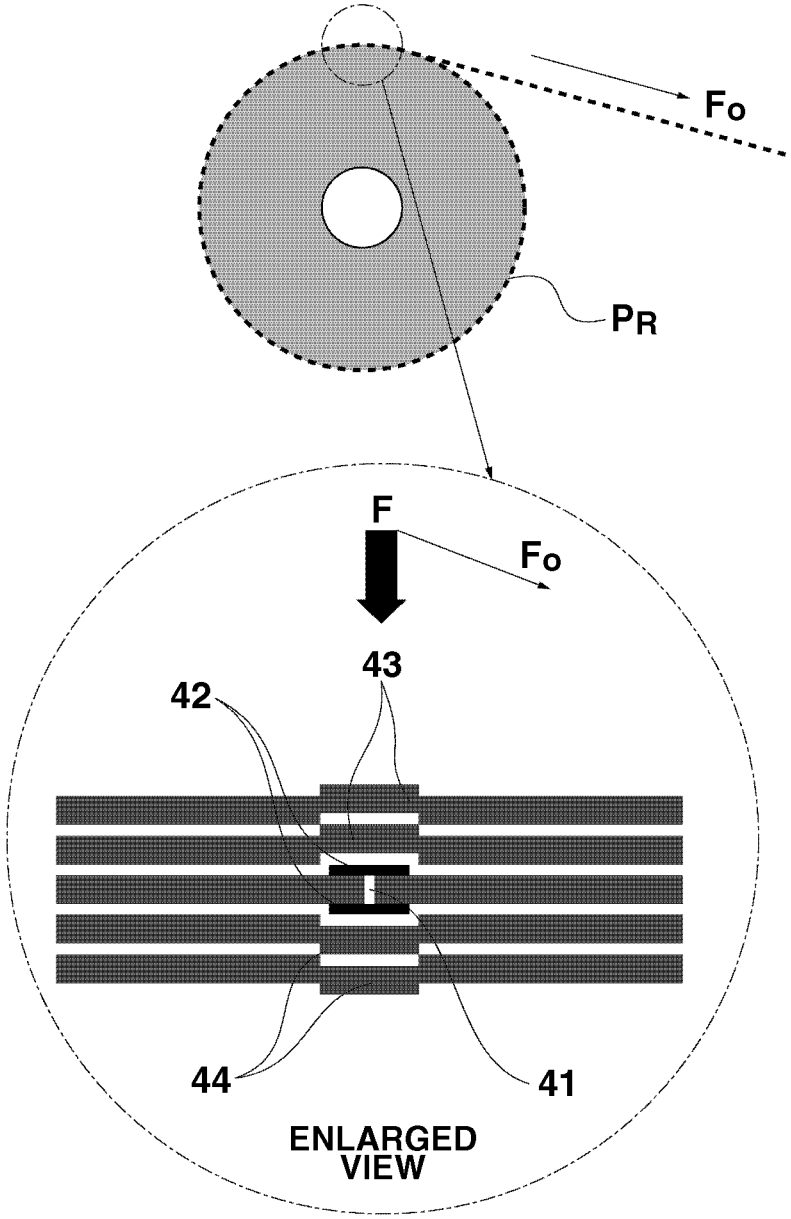
FIG. 16 is an enlarged view illustrating a splice portion of a roll$P_R$.

As illustrated in FIG. 16, the indentations 43 and 44 are areas influenced (deformed) by the tape 42 provided on both surfaces of the splice portion 41. Formation of the indentations 43 and 44 is not limited to the sheet portion corresponding to the first rotation of the roll that directly contacts the tape 42. Similar indentations may be formed on sheet surfaces corresponding to the second and subsequent rotations of the roll. The step height of an indentation newly formed on a sheet surface tends to reduce according to the number of rotations of the roll. Therefore, an indentation formed on a sheet surface during the third or subsequent rotation of the roll may not give any substantial influence on the quality of a printed image. Therefore, the present exemplary embodiment is directed to solve the situation that may be caused by the indentation formed on a sheet surface during the second rotation of the roll.

Figure 17:
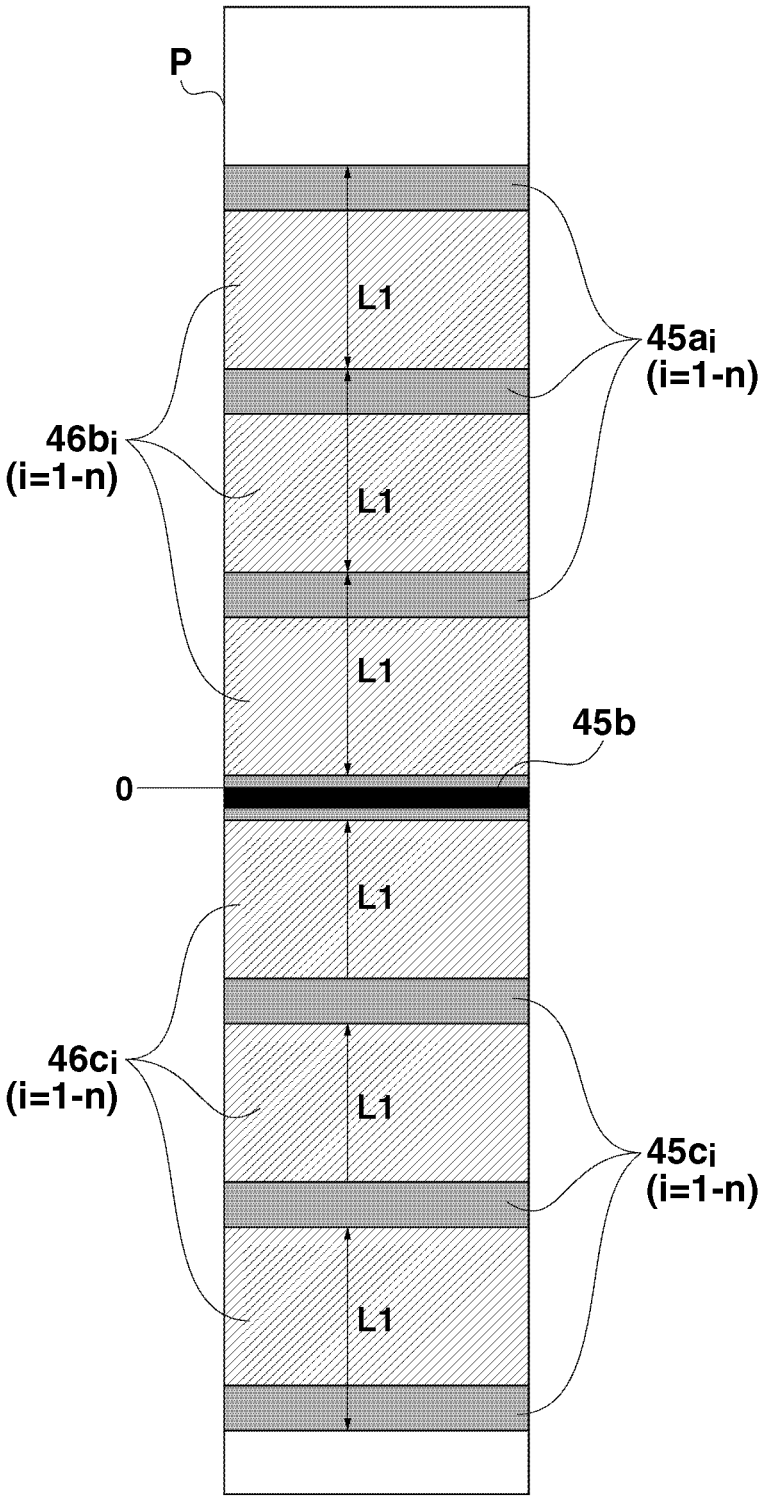
FIG. 17 illustrates an example setting of print areas according to a third exemplary embodiment of the present invention.

FIG. 17 illustrates a positional relationship between the splice portion 41 and areas influenced (deformed) by the splice portion 41 on the sheet P pulled out of the roll $P_R$. According to the example illustrated in FIG. 17, the print prohibited areas 45 (45$a_i$ and 45$c_i$) each including an indentation are provided at a plurality of portions (e.g., three portions) on the upstream and downstream sides of the splice portion 41 at substantially equal intervals (corresponding to the outer circumferential length L1 of the roll $P_r$) from the splice portion 41.

Figure 18:
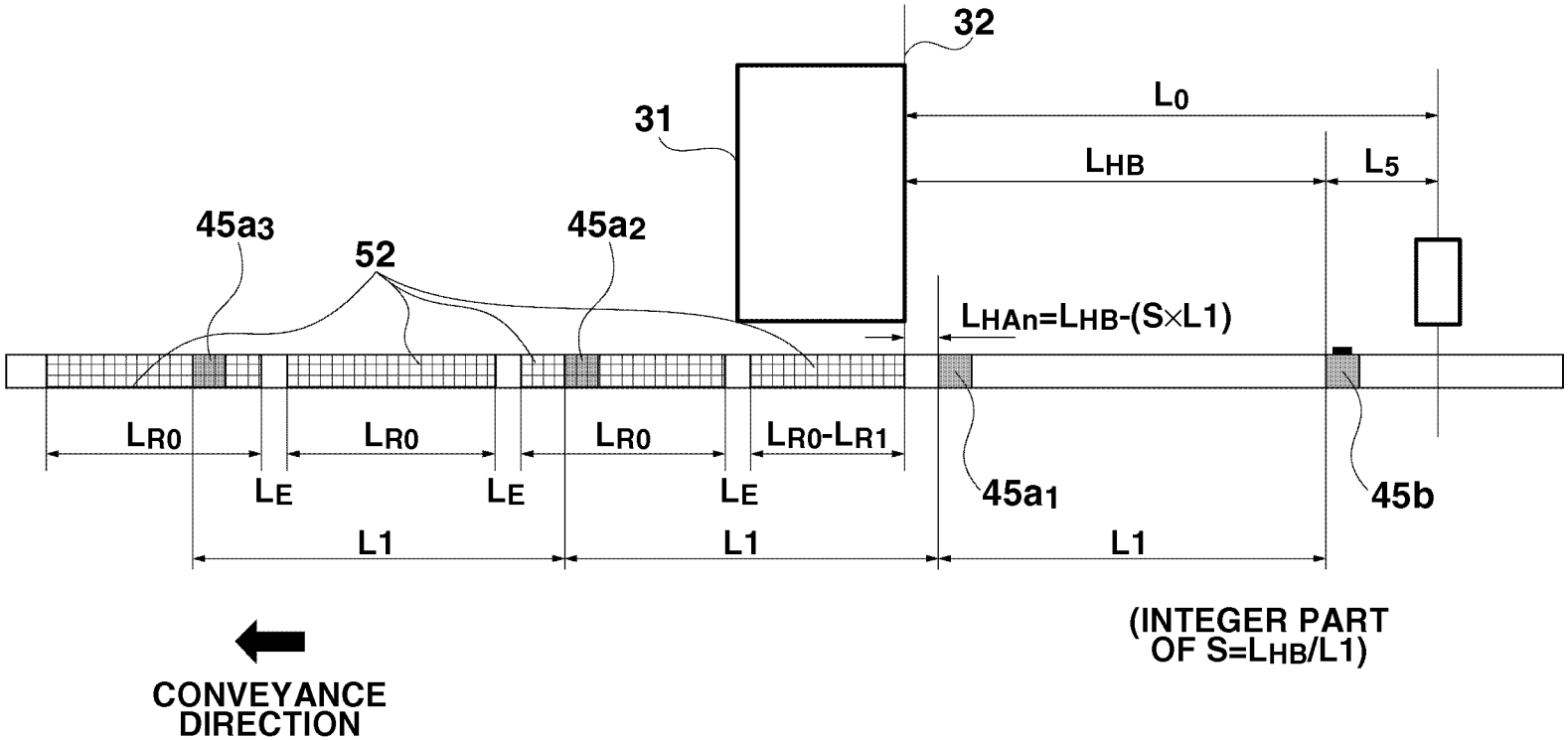
FIG. 18 illustrates a positional relationship between the recording head and a sheet.

An example procedure for controlling the print operation is described below with reference to FIG. 18. According to the example illustrated in FIG. 18, at the time when the setting of the print areas is completed, an image is already printed by the recording head 31 in one or more print prohibited areas 45$a_i$ (45$a_2$, 45$a_3$).

First, the control unit 100 calculates a distance $L_{HAi}$ between the print start position 32 and the most closet print prohibited area 45$a_i$ that is positioned on the upstream side of the print start position 32 according to the following procedure. The control unit 100 calculates the order of the closest print prohibited area 45$a_i$ on the downstream side of the print prohibited area 45$b$ that includes the splice portion 41 referring to an integer part of a value obtainable using a calculation formula $S=L_{HB}/L1$.

Subsequently, the control unit 100 calculates the distance $L_{HAi}$ using a calculation formula $L_{HAi}=L_{HB}-(S\times L1)$. For example, if $L_{HB}$=650 mm and L1=300 mm, the control unit 100 can identify the second print prohibited area 45$a_2$ positioned on the downstream side of the print prohibited area 45$b$ is the closest print prohibited area 45$a_i$ positioned on the upstream side of the print start position 32. Then, the control unit 100 can obtain a value 50 mm as a numerical value of the distance $L_{HA2}$ (i.e., $L_{HA2}$=50 mm).

Next, the control unit 100 compares the distance $L_{HAi}$ with the unprinted image length $L_{R1}$. If it is confirmed that a relationship $L_{HAi}<L_{R1}$ is satisfied (more specifically, in a case where a printed image may extend over the print selectable area into the closest print prohibited area 45$a_i$), the control unit 100 controls the recording head 31 to immediately stop the ink discharge operation.

On the contrary, if it is confirmed that a relationship $L_{HAi}>L_{R1}$ is satisfied (more specifically, in a case where a sufficient sheet space remains for the recording head 31 to complete the printing before the recording head 31 reaches the closest print prohibited area 45$a_i$, the control unit 100 causes the printing device 30 to continuously perform printing by an amount corresponding to the unprinted image length $L_{R1}$. In this case, the recording head 31 may be able to further print another image in the print selectable area 46$a$.

Hence, the control unit 100 calculates a number of sheets that are printable in the print selectable area 46$a$ using a calculation formula $(L_{HAi}-L_{R1})/(L_{R0}+L_E)$. In this case, an integer part of the value obtained through the calculation is the number of printable sheets. Then, the control unit 100 causes the printing device 30 to perform printing of images corresponding to the calculated number of sheets in the print selectable area 46$a$. For example, if $(L_{HAi}-L_{R1})$=150 mm, $L_{R0}$=127 mm, and $L_E$=10 mm, the control unit 100 obtains a value 1.09 (=150/(127+10)) through the above-described calculation. Therefore, the printing device 30 further prints one image corresponding to the integer part of the calculated value.

Next, the control unit 100 identifies an image (i.e., a defective product) recorded in the print prohibited area 45$a_i$ based on the values of $L_{HAn}$, $L_{R0}$, $L_{R1}$, L1, and $L_E$. The control unit 100 can identify a defective product from a group of minimum integer values xi that can satisfy a calculation formula $L_{HAi}+(L_{R0}-L_{R1})+(L_{R0}+L_E)x_i>L1\times i$ (i=1 to (n−S)). For example, if $L_{HAi}$=150 mm, $L_{R0}$=127 mm, $L_{R1}$=50 mm, $L_E$=10 mm, and L1=400 mm, the control unit 100 can obtain values $x_1$=1.26, $x_2$=4.18, . . . through the above-described calculation. Therefore, the control unit 100 determines that the second and fifth sheets are defective.

Further, in the case where the relationship $L_{HAi}<L_{R1}$ is satisfied, the control unit 100 determines that the data of the first image positioned on the downstream side of the closest print prohibited area 45$a_i$ as data of a defective product because print processing of the first image data has not been completed. Then, the control unit 100 generates a warning message indicating the identified defective product in the manner described in the first exemplary embodiment and adds as a final print job to the tail of sequential processing of print jobs.

Next, the control unit 100 obtains a number of sheets printable in the print selectable area 46$b_i$ positioned on the upstream side of the closest print prohibited area 45$a_i$ using a calculation formula $(L1-(L4+\alpha))/(L_{R0}+L_E)$ and causes the printing device 30 to perform printing of images corresponding to the calculated number of sheets in the print selectable area 46$b_i$. The control unit 100 repeats the above-described processing until the parameter "i" reaches "n" (i.e., i=n).

Further, the control unit 100 causes the sheet conveyance device 20 to convey the sheet P forward while preventing the printing device 30 from performing printing in the upstream print prohibited area 45*b*. Then, the control unit 100 causes the printing device 30 to resume the printing at timing when a downstream side of the print prohibited area reaches the print start position 32. However, if the length $L_{R0}$ of the effective image is longer than the length $L_C$ of the print selectable area 46*c*, the control unit 100 prevents the printing device 30 from performing printing in the print selectable area 46*c*.

On the contrary, if the length $L_{R0}$ is equal to or shorter than the length $L_C$, one or more images are printable in the print selectable area 46$c_i$ (i=1 to n). Therefore, the control unit 100 calculates a number of sheets printable in the print selectable area 46$c_i$ (i=1 to n) using a calculation formula $L_{Ci}/L_{R0}$. In this case, an integer part of the value obtained through the calculation is the number of printable sheets. Then, the control unit 100 causes the printing device 30 to perform printing of images corresponding to the calculated number of sheets in the print selectable area 46$c_i$. Finally, when an upstream side of the uppermost-stream print prohibited area reaches the print start position 32 of the recording head 31, the control unit 100 causes the printing device 30 to perform the remaining print processing, and terminates the print processing.

As described above, even when the tape repetitively forms indentations on sheet surfaces while the roll makes continuous rotations, the recording apparatus according to the present exemplary embodiment can prevent the printing device from recording an effective image at a sheet position corresponding to each indentation.

In an exemplary embodiment, the cutting device 40 equipped in the recording apparatus illustrated in FIG. 1 successively cuts the sheet P into pieces according to the effective image length $L_{R0}$ as post-processing to be performed on the sheet P having been subjected to the print processing performed by the printing device 30. In this case, the cutting device 40 can recognize a cut position referring to a cut mark printed on the sheet P. An example procedure of an operation that can be performed by the recording apparatus according to the present exemplary embodiment is described below.

Figure 19:
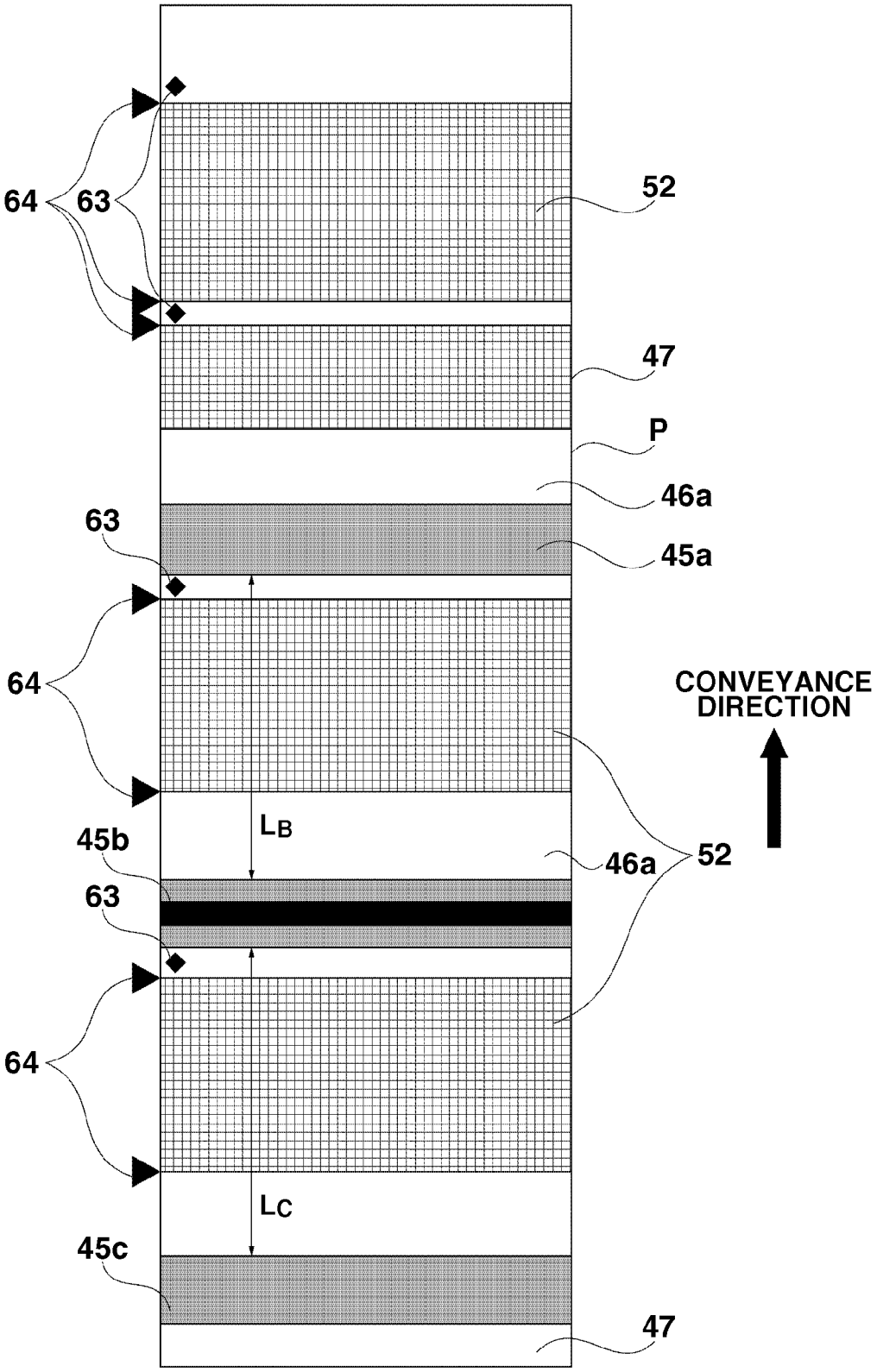
FIG. 19 illustrates an example setting of print areas according to an exemplary embodiment of the present invention.

When the recording apparatus performs printing, the control unit 100 causes the recording head 31 to print a cut mark 63 at a position adjacent to a downstream side of a print area 52 of the sheet P as illustrated in FIG. 19. The cut mark 63 is a reference mark that indicates a cut position to be referred to when the cutter 60 performs a cutting operation. The cut mark 63 printed on the sheet P is optically detectable by the cut mark sensor 61 provided on the upstream side of the cutter 60.

When the sub conveyance roller 24 discharges the sheet P from the printing device 30, the cut mark sensor 61 detects the cut mark 63 printed on the sheet P. A distance C between a detection position of the cut mark sensor 61 and the cut position of the cutter 60 is a fixed value determined beforehand. Further, a conveyance amount of the sheet P conveyed by the conveyance roller pair 62 is also known beforehand. Therefore, the cut mark 63 reaches the cut position of the cutter 60 at the time when the conveyance amount of the sheet P conveyed by the conveyance roller pair 62 reaches the distance C after the cut mark 63 is detected by the cut mark sensor 61.

The control unit 100 controls the cutter 60 to perform a cutting operation at predetermined timing based on detection of each cut mark 63, so that the sheet P can be accurately cut at an edge portion of the print area 52 neighboring the cut mark 63 (i.e., neighboring an upstream side of the cut mark 63). Further, the distance from a downstream edge portion of each print area 52 to an upstream edge portion thereof can be known from the length $L_{R0}$. Therefore, the control unit 100 drives the cutter 60 to cut the sheet P at timing when the sheet P travels the length $L_{R0}$ after the sheet P has been cut at its downstream edge portion.

In a case where two or more images are continuously arrayed in the same print area 52, the control unit 100 can control the cutter 60 to cut the sheet P along a borderline of each image to generate a cut sheet of each image. According to the example illustrated in FIG. 19, the cutter 60 cuts the sheet P at each cut position 64.

Thus, each sheet Pc cut by the cutting device 40 is discharged from the cutting device 40. Among the cut sheets Pc discharged in this manner, cut sheets on which an effective image is printed (e.g., three print areas 52 illustrated in FIG. 19 according to the present exemplary embodiment) are successively conveyed to the post-processing device 70 and subjected to predetermined post-processing.

On the other hand, defective products (areas other than the print areas 52 illustrated in FIG. 19) are not conveyed to the post-processing device 70, and are discharged as waste products into the collection box 71 by a separation and collection mechanism. If the collection box 71 is filled with waste products, a user can take out and clear the collection box 71.

As described above, the recording apparatus according to the present exemplary embodiment can automatically sort non-defective and defective products without relying on manual sorting performed by a user. Therefore, the recording apparatus can selectively output only non-defective products while separately collecting defective products. As a result, the usability of the recording apparatus can be improved. In this case, the recording apparatus is not required to display a warning message indicating the presence of a defective product.

Alternatively, the control unit 100 can drive the cutter 60 to cut the sheet P at a position without referring to the cut mark 63. More specifically, the distance from the print start position 32 of the recording head 31 to the cut position of the cutter 60 is a fixed value. Therefore, the control unit 100 can control the cutter 60 to start a cutting operation at a designated position of the sheet P while monitoring the conveyance amount of the sheet P after the print processing is completed. However, it is needless to say that using the cut mark 63 is useful to realize accurate positioning of the sheet P.

An example of a configuration of the splice sensor 13 according to the above-described exemplary embodiments is described below in more detail. Further, an operation of the splice sensor 13 is described below. The splice sensor 13 is an optical sensor (i.e., the reflection type photo sensor) that can detect a thin step height (i.e., a physically stepped portion) formed on a sheet.

Figure 20A:
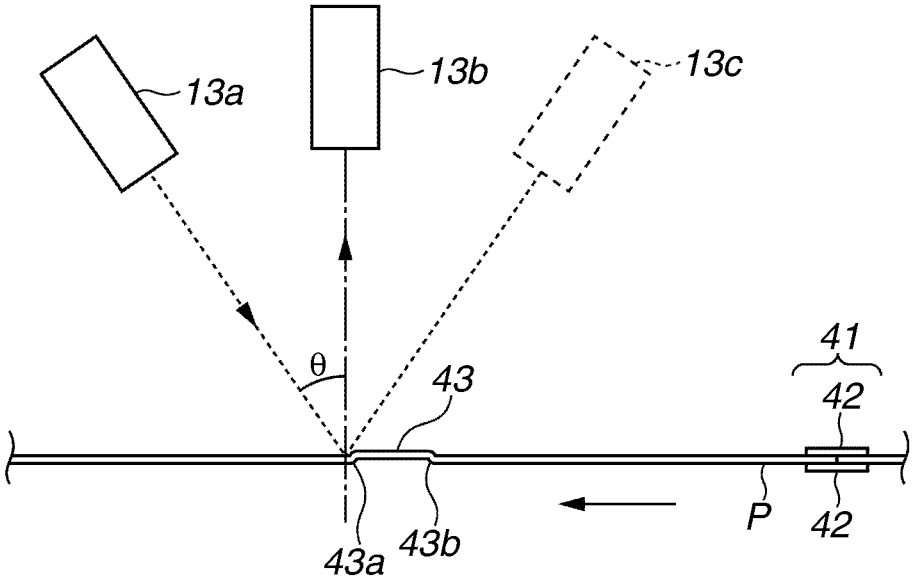
FIGS. 20A and 20B illustrate example arrangements of the splice sensor that detects a step height according to an exemplary embodiment of the present invention.
Figure 20B:
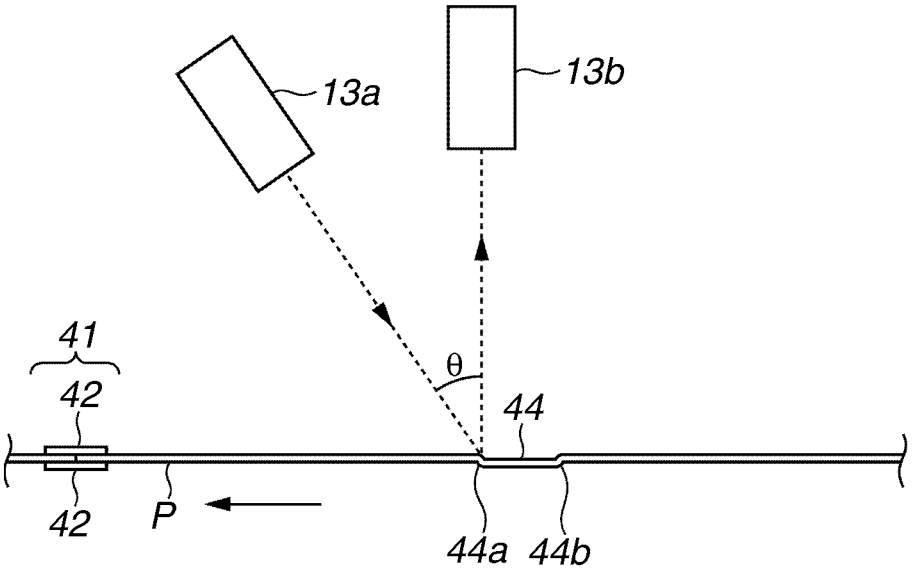

The splice sensor 13 illustrated in FIGS. 20A and 20B includes a light emitting device 13*a* and a light receiving device 13*b*. The light emitting device 13*a* can irradiate a sheet surface with an infrared ray, an ultraviolet ray, or visible light (spot light). For example, the light emitting device 13*a* can be constituted by a compact semiconductor light source such as a light emitting diode (LED), an organic light emitting diode (OLED), or a semiconductor laser.

The light receiving device 13*b* includes a light receiving lens and a light receiving element (e.g., a photo diode). The light receiving device 13*b* may include an image sensor (e.g., a charge coupled device (CCD) sensor or a Complementary Metal Oxide Semiconductor (CMOS) sensor) to detect an image, instead of using a photo diode.

The light emitting device 13*a* emits the spot light toward the sheet surface from a direction inclined by an angle θ relative to a vertical line. The irradiation angle θ of the spot-light (optical axis) is to be in a range from 30 to 60 degrees. A light receiving device 13*b* has a light receiving axis extending in the vertical direction. The light receiving device 13*b* receives a vertical component of the light that is diffused on the sheet surface when the sheet surface is irradiated with the spot light emitted from the light emitting device 13*a*. The irradiation position of the spot light is a detection position of the splice sensor 13. In the present exemplary embodiment, it is allowable that the light receiving axis is slightly inclined relative to the vertical direction.

Further, as indicated by a dotted line in FIG. 20A, a light receiving device 13*c* and the light emitting device 13*a* can be disposed symmetrically with respect to the vertical line perpendicular to the sheet surface. In this case, the optical axis of the light emitting device 13*a* and the optical axis of the light receiving device 13*c* are inclined by the same angle θ relative to the vertical direction. The light receiving device 13*c* mainly receives specular reflection of the spotlight reflected at the inspection detection position. In any one of the above-described optical arrangements, when the tape 42 of the splice portion 41 passes through the detection position, the light received by the light receiving device 13*b* changes in its signal level. Therefore, the control unit 100 can detect the splice portion 41 based on a signal change of the light receiving device 13*b*.

FIG. 20A and FIG. 20B illustrate the moment when the indentation (43 or 44) reaches the detection position of the splice sensor 13 when the sheet P is conveyed in the direction indicated by an arrow. When the tape 42 passes through the detection position, the splice sensor 13 generates a pulse signal at each of both edge portions of the tape 42. If a surface reflectance of the tape 42 is greater than that of the sheet P, the signal level of the splice sensor 13 increases when the tape 42 is moving across the detection position. On the contrary, if the surface reflectance of the tape 42 is smaller than that of the sheet P, the signal level of the splice sensor 13 decreases when the tape 42 is moving across the detection position. Thus, the control unit 100 can detect the splice portion 41 in response to the signal change of the splice sensor 13.

In the above-described exemplary embodiments, the control unit 100 obtains the position of an indentation based on estimation using positional information of a splice portion detected by the splice sensor 13 and a momentary outer circumferential length of the roll. In another exemplary embodiment, the splice sensor 13 can be used to directly detect indentations, as described below.

The splice sensor 13 detects a thin step height formed on a sheet. As illustrated in FIG. 20A, a step height of the tape 42 of the splice portion 41 and a step height of the indentation 43 are formed on the sheet P.

Accordingly, the signal level of reflection light or diffused light detected by the splice sensor 13 changes significantly every time when a step height formed on the sheet P passes through the detection position of the splice sensor 13. Therefore, the control unit 100 can detect not only the splice portion 41 but also the indentation 43 based on pulse signals generated by the splice sensor 13.

The splice sensor 13 can be constituted by a transmission type photo sensor, which can detect the splice portion 41 based on a difference in transmissivity between the sheet P and the tape 42. Further, the type of the splice sensor 13 is not limited to an optical type. For example, a contact type sensor can be used as the splice sensor 13. The contact type sensor can detect the splice portion 41 as a change in thickness of the tape 42 by sensing a change thereof in moving amount of a contactor that contacts the sheet P.

FIG. 20A illustrates the indentation 43 formed on the sheet P and having a convex shape protruding toward the splice sensor 13 in a state where the first step height 43*a* (i.e., an ascending side) of the indentation 43 just passes through the detection position of the splice sensor 13. FIG. 20B illustrates the indentation 44 formed on the sheet P and having a concave shape retracting from the sheet surface in a state where the first step height 44*a* (i.e., a descending side) of the indentation 44 just passes through the detection position of the splice sensor 13.

The splice sensor 13 can detect each indentation regardless of its protruding direction. However, respective step heights of the indentations 43 and 44 are relatively low in height and inclined in its cross-sectional shape compared to the step heights of the tape 42. Hence, the control unit 100 can surely detect each indentation, and discriminate the indentation from the splice portion by analyzing an output signal of the splice sensor 13.

Figure 21:
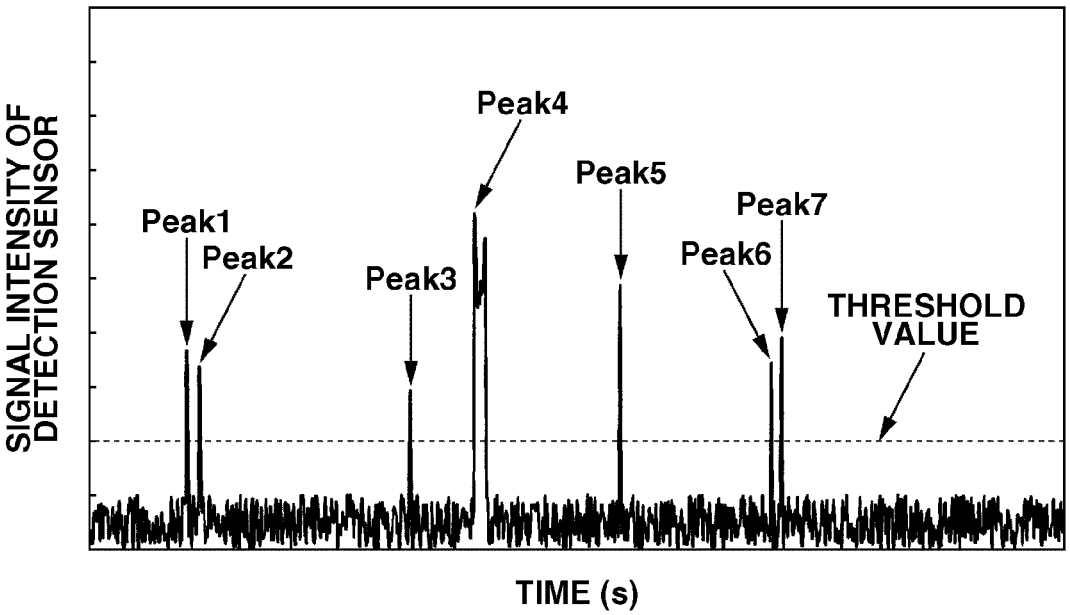
FIG. 21 is a graph illustrating an example of a waveform of a signal output from the splice sensor.

In the present exemplary embodiment, the sheet P illustrated in FIG. 5 passes through the splice sensor 13. FIG. 21 is a graph illustrating an example of a waveform of a signal output from the splice sensor 13, in which the abscissa axis represents elapsed time and the ordinate axis represents the strength of the sensor signal.

When the splice portion 41 passes through the detection position, the splice sensor 13 generates a signal indicated by Peak 4. The sheet P and the tape 42 are different in material and therefore their surface reflectance values are mutually different. In general, the tape 42 has a surface reflectance greater than that of the sheet P. Therefore, the signal indicated by Peak 4 is largest in strength.

The signal indicated by Peak 4 has a waveform including two pulses appearing at a predetermined interval, which represent both edge portions of the tape 42. The signal level in a region between two pulses is greater than that of a region corresponding to the sheet P because the surface reflectance of the tape 42 is greater than that of the sheet P.

The control unit 100 performs the following processing to determine whether the signal indicated by Peak 4 is a signal generated by the splice portion 41. The width (=L4) of the tape 42 in the sheet conveyance direction and the average conveyance speed (=V) are constant values. Therefore, a theoretical time used for the tape 42 to pass through the detection position can be obtained as a constant value (=L4/V). When the period of time during which the signal indicated by Peak 4 is output (i.e., time interval $t_d$ during which the signal intensity is continuously greater than a threshold value), i.e., the pulse width, is equal to the above-described predetermined period of time (L4/V), and the signal strength is continuously greater than the threshold value, the control unit 100 determines that detected portion is the splice portion 41.

In the present exemplary embodiment, tolerance of the tape width, variation of the conveyance speed, spot size of the detection position, and variation of luminance are taken into consideration in setting a predetermined time margin β that is used in the above-described determination.

Peak 1 and Peak 2 indicate two pulse signals generated by the step heights 43*a* and 43*b* of the downstream side indentation 43. Further, Peak 6 and Peak 7 indicate two pulse signals generated by the step heights 44*a* and 44*b* of the upstream side indentation 44. The signals indicated by Peak 1, Peak 2, Peak 6, and Peak 7 are smaller in signal strength compared to that of the signal indicated by Peak 4, because a sheet surface extending between two edge portions (two neighboring step heights) of each indentation is not different from other normal sheet surface in reflectance.

The control unit 100 performs the following processing to determine whether the signals indicated by Peak 1, Peak 2, Peak 6, and Peak 7 are generated by the indentations 43 and 44. The distance between two step heights of the downstream side indentation 43 is equal to the width (=L4) of the tape 42 in the sheet conveyance direction. Therefore, a theoretical time used for the step heights 43*a* and 43*b* to pass through the detection position can be obtained as a constant value (=L4/V) that is similar to that for the splice portion 41.

If the time duration between two signals indicated by Peak 1 and Peak 2 is equal to the above-described predetermined period of time (=L4/V) and the signal strength is continuously equal or lower than the threshold value, the control unit 100 determines that detected portion is the indentation 43. The control unit 100 performs similar processing to identify the upstream side indentation 44. The above-described predetermined time margin β is taken into consideration in the above-described determination.

In the graph of FIG. 21, Peak 3 and Peak 5 represent error signals generated by foreign particles randomly adhering on a sheet or pulse signals caused by electric noises. The signals indicated by Peak 3 and Peak 5 are greater than the threshold value in signal strength. The control unit 100 is thus used to prevent the signals indicated by Peak 3 and Peak 5 from being erroneously recognized as signals indicating the splice portion or the indentation.

However, almost all of general noises are detectable as a one-shot pulse, which can be discriminated from the above-described signal representing the splice portion or the indentation that has a characteristic waveform including two pulses at both ends thereof. Even in a case where two or more pulses are continuously generated, it is rare that the time interval between the generated consecutive pulses coincides with the above-described predetermined period of time (theoretical value). Therefore, in many cases, the control unit 100 can prevent the error signals from being recognized as signals indicating the splice portion or the indentation.

As described above, in the present exemplary embodiment, the control unit 100 detects a splice portion or an indentation by checking whether an output signal of the splice sensor 13 includes a characteristic change that corresponds to a predetermined period of time theoretically used to move the sheet by a distance corresponding to the width of the splice portion in the sheet conveyance direction.

More specifically, the signal change to be checked by the control unit 100 is occurrence of two specific pulses appearing at a time interval comparable to the above-described predetermined time. If it is determined that the signal level between two specific pulses is greater than a threshold value, the control unit 100 determines that a detected portion is a splice portion. If it is determined that the signal level between two specific pulses is equal to or less than the threshold value, the control unit 100 determines that the detected portion is an indentation. The control unit 100 prevents the printing device 30 from recording an effective image at the splice portion and the indentation based on a detection result of the indentation and splice portion according to the procedure described in the above-described exemplary embodiments.

Figure 22:
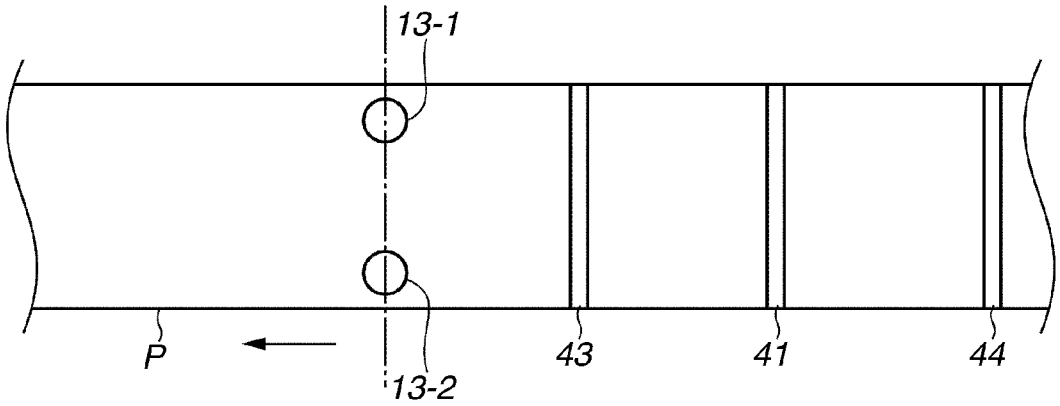
FIG. 22 illustrates an example of a sensor configuration using a pair of splice sensors according to an exemplary embodiment of the present invention.

As another exemplary embodiment, two or more splice sensors 13 can be provided to reduce the possibility of the above-described error recognition. FIG. 22 illustrates an example of another sensor configuration using a pair of splice sensors 13. A first splice sensor 13-1 and a second splice sensor 13-2 are disposed in a spaced relationship along a sheet width direction (i.e., a direction perpendicular to the sheet conveyance direction).

In this case, detection positions of two splice sensors 13-1 and 13-2 are in a spaced relationship along the sheet width direction. Each of the splice sensors 13-1 and 13-2 has a configuration similar to that of the optical sensor illustrated in FIG. 20A or FIG. 20B. The maximum number of splice sensors is not limited to two. Therefore, three or more splice sensors can be provided.

Figure 23:
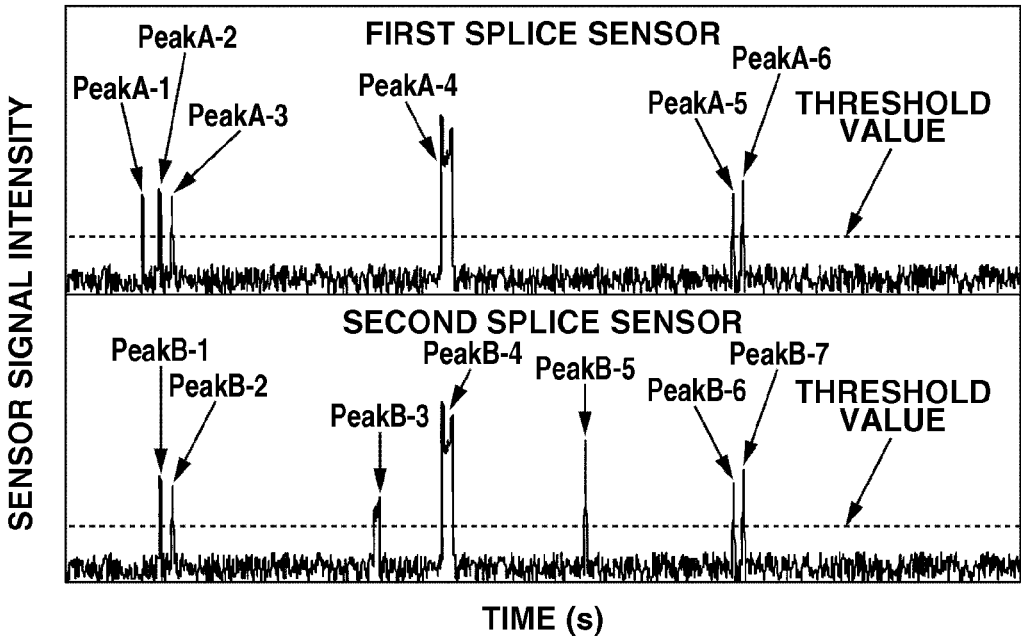
FIG. 23 is a graph illustrating an example of waveforms of signals output from two splice sensors.

FIG. 23 is a graph illustrating an example of waveforms of signals output from the splice sensors 13-1 and 13-2, in which an upper part indicates the strength of a signal generated by the first splice sensor 13-1 and a lower part indicates the strength of a signal generated by the second splice sensor 13-2.

The splice portion 41 and the indentations 43 and 44 are formed on the sheet P so as to extend entirely in the width direction of the sheet P. Therefore, when the splice portion 41 or the indentation 43 or 44 passes through the detection positions of two splice sensors 13-1 and 13-2, signals having substantially the same waveform are output from respective splice sensors at substantially the same timing. On the contrary, pulse signals generated by foreign particles randomly adhering on a sheet or pulse signals caused by electric noises are not simultaneously output from two splice sensors 13-1 and 13-2.

The above-described differences can be taken into consideration to reduce the possibility of erroneously detecting foreign particles and electric noises as the splice portion or the indentation. More specifically, if pulse signals whose signal strength is equal to or greater than a threshold value are generated from two splice sensors 13-1 and 13-2 at substantially the same timing, the control unit 100 determines that these signals are generated by the splice portion or the indentation. On the other hand, if a pulse signal whose signal strength is equal to or greater than the threshold value is generated from only one of two splice sensors 13-1 and 13-2, the control unit 100 determines that this signal is an error signal generated by a foreign particle or an electric noise and discards this signal.

In the above-described determination, if an error included in time measurement information is small, the control unit 100 regards it as being included in the "substantially the same timing." In an exemplary case, the splice portion 41 and the indentations 43 and 44 may not have constant dimensions along the sheet width direction. Further, two detection positions (irradiation spot positions) of the splice sensors in the sheet conveyance direction may not be identical to each other.

If the time difference in signal generation between the first splice sensor 13-1 and the second splice sensor 13-2 is smaller than a predetermined allowable time, the control unit 100 determines that these signals are generated at substantially the same timing.

According to the example illustrated in FIG. 23, the first splice sensor 13-1 generates three pulse signals (Peak A-1, Peak A-2, and Peak A-3) exceeding the threshold value in an area including the indentation 43 and its vicinity. On the other hand, the second splice sensor 13-2 generates two pulse signals indicated by Peak B-1 and Peak B-2. Of five signals, two pulse signals indicated by Peak A-1 and Peak B-1 are generated at the same timing and two pulse signals indicated by Peak A-2 and Peak B-2 are generated at the same timing. Therefore, the control unit 100 determines that the remaining pulse signal indicated by Peak A3 is an error signal generated by a foreign particle or an electric noise and discards this signal.

Further, according to the example illustrated in FIG. 23, the second splice sensor 13-2 further generates a pulse signal indicated by Peak B-3 having a pulse width similar to that of a pulse signal indicated by Peak B-4. Further, the second splice sensor 13-2 generates a pulse signal indicated by Peak B-5 that also exceeds the threshold value. However, the first splice sensor 13-1 does not generate any pulse signals similar to the pulse signals indicated by Peak B-3 and Peak B-5 at the same timing. Therefore, the control unit 100 determines that these signals indicated by Peak B-3 and Peak B-5 are error signals generated by foreign particles or electric noises and discards these signals.

Similar to the above-described example, if the time interval between two specific pulse signals coincides with the above-described predetermined period of time (L4/V), the control unit 100 determines that a detected portion is the splice portion 41 or the indentation 43 or 44. Further, if the signal level between two consecutive specific pulse signals is greater than the threshold value, the control unit 100 determines that the detected portion is the splice portion 41. If the signal level between two consecutive specific pulse signals is equal to or less than the threshold value, the control unit 100 determines that the detected portion is the indentation 43 or 44.

As described above, if it is determined that the first splice sensor 13-1 and the second splice sensor 13-2 generate pulse signals whose signal strength exceeds the threshold value at substantially the same timing, the control unit 100 determines that these signals are genuine signals generated by the splice portion or the indentation. Therefore, in many cases, the control unit 100 can prevent the error signals generated by foreign particles or electric noises from being recognized as signals indicating the splice portion or the indentation.

As another exemplary embodiment, the above-described estimation and the direct detection are combinable to further reduce the possibility of erroneously detecting a foreign particle or an electric noise as a splice portion or an indentation. As described in the first exemplary embodiment, if the splice portion 41 is detected by the splice sensor 13, the control unit 100 estimates the position of the next indentation 44 based on a momentary value indicating the outer circumferential roll size. Then, the control unit 100 directly detects the next indentation 44 with the splice sensor 13 in a limited area including the estimated position.

Further, if the first indentation 43 positioned on the downstream side is detected by the splice sensor 13, the control unit 100 estimates the position of the splice portion 41 based on a momentary value indicating the outer circumferential roll size. Then, the control unit 100 directly detects the splice portion 41 with the splice sensor 13 in a limited area including the estimated position.

The above-described combined estimation and direct detection is useful to further reduce the possibility of erroneous recognition because many of foreign particles not existing in the limited detection area or many of electric noises not generated during the limited detection period can be excluded from objects to be detected. The control unit prevents the printing device 30 from recording an effective image in the areas corresponding to the detected indentations and splice portions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An apparatus comprising:

a holding unit configured to hold a roll of a sheet having splice portions;

a printing unit configured to record an image on the sheet while the sheet is conveyed;

a detection unit, including at least one optical sensor having an emitting device that irradiates light on a surface of the sheet and a receiving device that receives the light from the surface of the sheet, configured to detect an indentation on the sheet that is formed in addition to the splice portion; and a control unit configured to control so as to prevent the printing unit from recording an effective image at or in the vicinity of the splice portion and at or in the vicinity of the indentation position, based on a detection result of the detection unit, wherein the detection unit is configured to detect the indentation by checking whether a signal representing the received light has signal changes that are spaced apart by a predetermined period of time required for the sheet to move by a distance equivalent to a width of the splice portion in a conveyance direction.

2. The apparatus according to claim 1, wherein the signal changes are an occurrence of two specific pulse signals appearing at a time interval comparable to the predetermined time.

3. The apparatus according to claim 2, wherein the detection unit is configured to identify a detected portion as the splice portion if a signal level between two specific pulse signals is higher than a threshold value, and the detected portion as the indentation if the signal level between two specific pulse signals is equal to or less than the threshold value.

4. The apparatus according to claim 1, wherein the at least one optical sensor includes a first optical sensor and a second optical sensor, and the detection unit discards a detection result if the signal changes are detected by only one of the first and second optical sensors.

* * * * *